US007091460B2

(12) United States Patent
Kinzer

(10) Patent No.: US 7,091,460 B2
(45) Date of Patent: Aug. 15, 2006

(54) IN SITU PROCESSING OF HYDROCARBON-BEARING FORMATIONS WITH VARIABLE FREQUENCY AUTOMATED CAPACITIVE RADIO FREQUENCY DIELECTRIC HEATING

(76) Inventor: Dwight Eric Kinzer, 413 29th Ave., Fargo, ND (US) 58102-1508

( * ) Notice: Subject to any disclaimer, the term of this patent is extended or adjusted under 35 U.S.C. 154(b) by 88 days.

(21) Appl. No.: 10/801,458

(22) Filed: Mar. 15, 2004

(65) Prior Publication Data

US 2005/0199386 A1 Sep. 15, 2005

(51) Int. Cl.
*H05B 6/46* (2006.01)

(52) U.S. Cl. ..... 219/772; 219/771; 219/778; 166/248

(58) Field of Classification Search ..... 219/770, 219/772, 778–780; 392/301–303; 166/269, 166/263, 272, 299, 398, 60, 261, 267, 303, 166/306, 307, 308, 248; 366/137
See application file for complete search history.

(56) References Cited

U.S. PATENT DOCUMENTS

| | | | | |
|---|---|---|---|---|
| 4,135,579 | A | 1/1979 | Rowland et al. | |
| 4,144,935 | A | 3/1979 | Bridges et al. | |
| 4,457,365 | A | 7/1984 | Kasevich et al. | |
| 4,470,459 | A | 9/1984 | Copland | |
| 4,513,815 | A | 4/1985 | Rundell et al. | |
| 4,638,863 | A | 1/1987 | Wilson | |
| 4,645,004 | A * | 2/1987 | Bridges et al. | 166/248 |
| 5,109,927 | A | 5/1992 | Supernaw et al. | |
| 5,199,488 | A | 4/1993 | Kasevich et al. | |
| 5,236,039 | A | 8/1993 | Edelstein et al. | |
| 5,293,936 | A | 3/1994 | Bridges | |
| 5,370,477 | A | 12/1994 | Bunin et al. | |
| 5,689,215 | A | 11/1997 | Richardson et al. | |
| 6,086,830 | A | 7/2000 | Kartchner | |
| 6,189,611 | B1 | 2/2001 | Kasevich | |

(Continued)

OTHER PUBLICATIONS

Kasevich, R.S., "Understand the potential of radiofrequency energy," in: Chemical Engineering Progress. Jan. 1998, pp. 75-81.

(Continued)

*Primary Examiner*—Quang Van

(57) ABSTRACT

A hydrocarbon bearing formation which is heated using a variable frequency automated capacitive radio frequency dielectric heating in situ process. Hydrocarbons or other substances natural to a hydrocarbonaceous formation may be produced by heating specific chemical compositions with or without the use of a carrier medium. Separation of desired hydrocarbons from less sought-after constituents can occur in carrier medium subterranean reservoir. Hydrocarbon media can be slurry heated using a variable frequency automated capacitive radio frequency dielectric heating method. Slurry heated hydrocarbon media can be ejected to lower depths of carrier medium reservoir to impart hydrostatic pressure onto media. Hydraulic pressure blasted at cavern wall with carrier medium fluid possessing variable frequency automated capacitive radio frequency dielectric heating properties will be used to enlarge cavern size. Explosives can be used to enlarge cavern outer perimeter. The rubble from the hydraulic digging and/or explosion(s) will deposit hydrocarbonaceous substances in cavern carrier medium reservoir for heating and extraction of desired hydrocarbons. Remote vessels can be used in cavern reservoir to direct heating frequencies, for hydraulic mining, and/or for re-circulating carrier medium.

23 Claims, 16 Drawing Sheets

U.S. PATENT DOCUMENTS

| | | | | |
|---|---|---|---|---|
| 6,259,334 | B1 | 7/2001 | Howald | |
| 6,303,166 | B1 | 10/2001 | Kolbe et al. | |
| 6,657,173 | B1 | 12/2003 | Flugstad et al. | |
| 6,688,387 | B1 | 2/2004 | Wellington et al. | |
| 2002/0047009 | A1* | 4/2002 | Flugstad et al. | 219/771 |

OTHER PUBLICATIONS

Sahni, A., Kumar, M., and Knapp, R.B. "Electromagnetic Heating Methods for Heavy Oil Reservoirs." US Dept of Energy, May 1, 2000; Reprint UCRL-JC-138802.

* cited by examiner

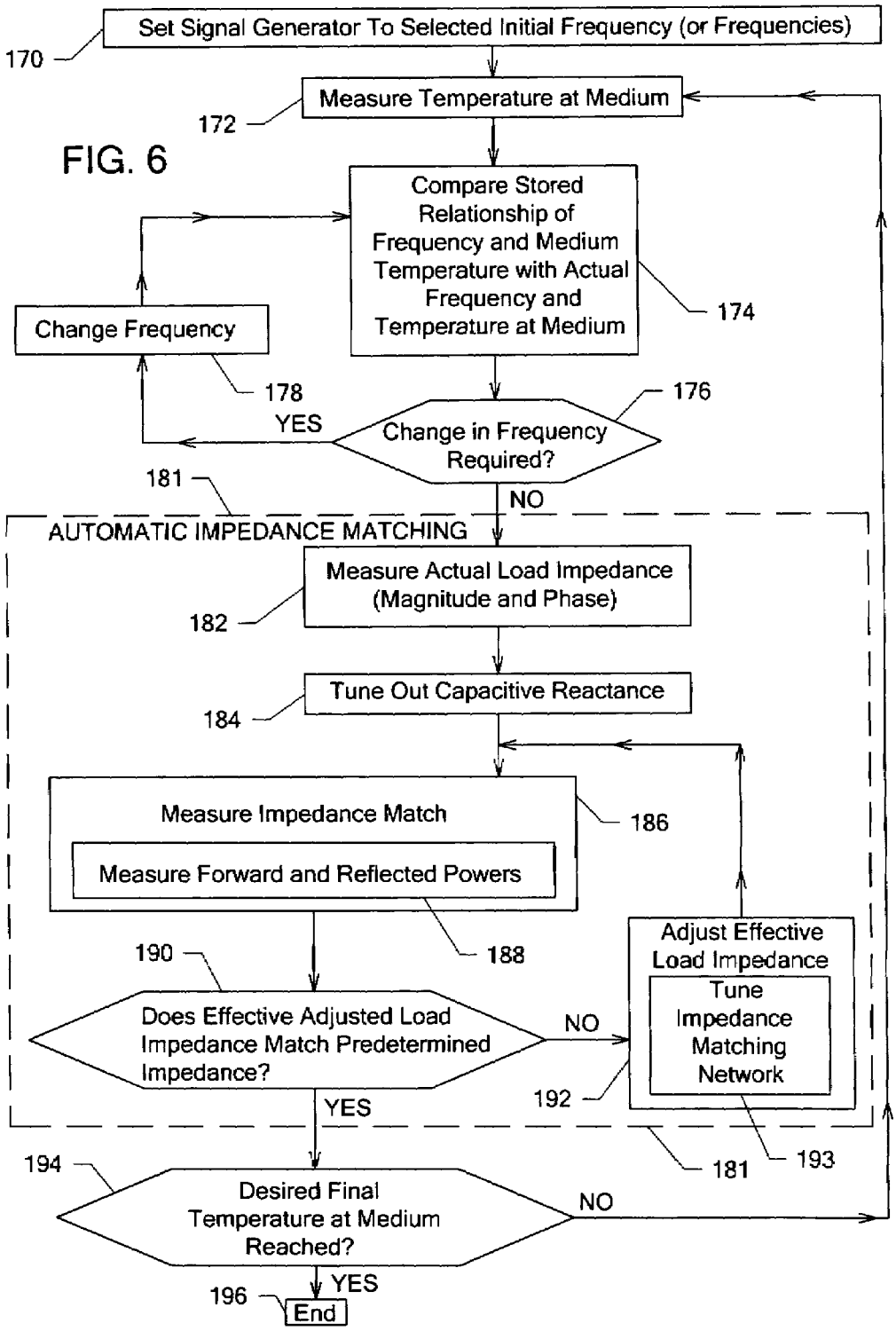
Set Signal Generator To Selected Initial Frequency (or Frequencies)
170
Measure Temperature at Medium
172
FIG. 6
Compare Stored Relationship of Frequency and Medium Temperature with Actual Frequency and Temperature at Medium
174
Change Frequency
178
176
YES
Change in Frequency Required?
181
NO
AUTOMATIC IMPEDANCE MATCHING
Measure Actual Load Impedance (Magnitude and Phase)
182
Tune Out Capacitive Reactance
184
Measure Impedance Match
186
Measure Forward and Reflected Powers
188
190
Adjust Effective Load Impedance
Tune Impedance Matching Network
Does Effective Adjusted Load Impedance Match Predetermined Impedance?
NO
192
YES
181
193
194
Desired Final Temperature at Medium Reached?
NO
YES
196
End

IN SITU PROCESSING OF HYDROCARBON-BEARING FORMATIONS WITH VARIABLE FREQUENCY AUTOMATED CAPACITIVE RADIO FREQUENCY DIELECTRIC HEATING

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION—FIELD OF THE INVENTION

This invention relates to hydrocarbon extraction and processing, specifically to heating hyrdrocarbonaceous formations in situ for more efficient extraction and processing.

BACKGROUND OF THE INVENTION—DISCUSSION OF PRIOR ART

North American reserves of oil shale and tar sand contain enough hydrocarbonaceous material to be a global provider of hydrocarbons products for the foreseeable future. Large-scale commercial exploitation of certain hydrocarbon-bearing resources, available in huge deposits on the North American continent, has been impeded by a number of problems, especially cost of extraction and potentially significant negative environmental impact. Oil shale is also plentiful in the United States, but the cost of useful fuel recovery has been generally noncompetitive. The same is true for tar sands, which occur in estimated vast number of problems, amounts in Western Canada. In addition, heavy or viscous oil is often left untapped in a conventionally-produced oil well, due to the extra cost of extraction. These types of hydrocarbon deposits are becoming increasingly important, as reserves of low viscosity crude petroleum are being quickly depleted.

Materials such as oil shale, tar sands, and coal are amenable to heat processing to produce gases and hydrocarboneous liquids. Generally, the heat develops the porosity, permeability, and/or mobility necessary for recovery. Oil shale is a sedimentary rock, which upon pyrolysis, or distillation, yields a condensable liquid, referred to as a shale oil, and non-condensable gaseous hydrocarbons. The condensable liquid may be refined into products that resemble petroleum products. Oil sand is an erratic mixture of sand, water, and bitumen, with the bitumen typically being present as a film around water-enveloped sand particles. Though difficult, various types of heat processing can release the bitumen, which is an asphalt-like crude oil that is highly viscous.

In the destructive distillation of oil shale or other solid or semi-solid hydrocarbonaceous materials, the solid material is heated to an appropriate temperature and the emitted products are recovered. In practice, however, the limited efficiency of this process has prevented achievement of large-scale commercial application. For example, the desired organic constituent in oil shale, known as kerogen, constitutes a relatively small percentage of the bulk shale material, so very large volumes of shale need to be heated to elevated temperatures in order to yield relatively small amounts of useful end products. The handling of the large amounts of material is, in itself, a problem, as is the disposal of wastes. Also, substantial energy is needed to heat the shale, and the efficiency of the heating process and the need for relatively uniform and rapid heating have been limiting factors on success.

In the case of tar sands, the volume of material to be handled, as compared to the amount of recovered product, is again relatively large, since bitumen typically constitutes only about ten percent of the total, by weight. Material handling of tar sands is particularly difficult even under the best of circumstances. Such processing potentially results in huge, negative environmental impacts.

A number of proposals, broadly classed as in situ methods, have been made for processing and recovering hydrocarbonaceous deposits. Such methods may involve underground heating or retorting of material in place, with little or no mining or disposal of solid material in the formation. Useful constituents of the formation, including heated liquids of reduced viscosity, may be drawn to the surface by a pumping system or forced to the surface by injection techniques. For such methods to be successful, the amount of energy required to effect the extraction must be minimized.

Proposals to use radio frequency to heat relatively large volumes of hydrocarbonaceous formations are exemplified by the disclosures of the following U.S. patents: U.S. Pat. No. 4,140,180 to Bridges et al., 1979; U.S. Pat. No. 4,135,579 to Rowland et al., 1979; U.S. Pat. No. 4,140,179 to Kasevich et al., 1979; U.S. Pat. No. 4,144,935 to Bridges et al.,. (1980); U.S. Pat. No. 4,193,451 to Dauphine 1980; U.S. Pat. No. 4,457,365 to Kasevich et al., 1984; U.S. Pat. No. 4,470,459 to Copland et al., 1984; U.S. Pat. No. 4,513,815 to Rundell et al., 1985; U.S. Pat. No. 5,109,927 to Supernaw et al., 1992; U.S. Pat. No. 5,236,039 to Edelstein et al., 1993; and U.S. Pat. No. 6,189,611 to Kasevich et al., 2001.

One proposed electrical in situ approach employs a set of arrays of dipole antennas located in a plastic or other dielectric casing in a formation, such as a tar sand formation. A VHF or UHF power source would energize the antennas and cause radiating fields to be emitted into the deposit. However, at these frequencies, and considering the electrical properties of the formations, the field intensity drops rapidly as distance from the antennas increases. Consequently, non-uniform heating results in inefficient overheating of portions of formations in order to obtain at least minimum average heating of the bulk of the formations.

Another past proposal utilizes in situ electrical induction heating of formations. As in other proposals, the process depends on the inherent conduction ability, which is limited even under the best of conditions, of the formations. In particular, secondary induction heating currents are induced in the formations by forming an underground toroidal induction coil and passing electrical current through the turns of the coil. Drilling vertical and horizontal boreholes forms the underground toroid, and conductors are threaded through the boreholes to form the turns of the toroid. However, as the formations are heated and water vapors are removed from it, the formations become more resistive, and greater currents are required to provide the desired heating. In general, the above-mentioned techniques are limited by the relatively low thermal and electrical conductivity of the bulk formations of interest. Thus, the inefficiencies resulting from non-uniform heating render existing techniques slow and inefficient.

Currently, the most commercially accepted method of in situ extraction of hydrocarbons from oil tar sands is the steam flood process that uses a combination of steam or other gaseous pressures along with RF to decrease the viscosity so as to force the oil through the sand to a nearby producer well. This process requires enormous amounts of high-pressure steam that is typically generated with natural gas. On the down side, as price of crude oil increases, the price of natural gas generally rises accordingly, increasing the cost of employing steam flood methods. The steam flood method has been blamed for disrupting natural gas pressures; so the gas producers want to extract their natural gases prior to bitumen recover. But, the users of steam flood bitumen recovery processes need the subterranean pressures from the natural gas reservoirs to assist the steam flood. The loss of the natural gas reservoir can make the steam flood process uneconomical.

Controlled or uniform temperature heating of a hydrocarbonaceous volume to be recovered is desirable, but current methods cannot achieve this goal. Instead, current methods generally result in non-uniform temperature distributions, which can result in the necessity of inefficient overheating of portions of the formations. Extreme temperatures in localized areas may cause damage to the producing volume such as carbonization, skinning of the paraffin waxes, and arcing between the conductors can occur. Furthermore, vaporization of water creates steam that negatively affects the passage of frequency waves to the substances that require heating.

None of the previous proposals for the extraction of hydrocarbons from these types of formations have provided a method of separating the foreign matter from the valuable hydrocarbons prior to extracting to the surface of the earth. The washing of sand from heated oils generally requires steam or other energy consuming processes. The foreign matter in tar sand may contain ten times the desired hydrocarbons. As a result, a substantial negative environmental impact, with respect to disposal of the undesirable foreign matter, would exist if enough hydrocarbons were extracted to support a North American or global demand of oil. Another problem with washing the sand from the oil is the amount of water that would be required for large-scale production. Not only would tremendous amounts of fresh water be required, but also disposal of the resulting contaminated water would be an important issue. Disposing of the undesirable organic and inorganic substances such as heavy metals, sulfur, etc that would be separated from the hydrocarbons would impose additional environmental challenges. Furthermore, extracting large amounts of heated bitumen and heavy oils to the surface of the earth can release sizable amounts of greenhouse gases and other pollutants into the atmosphere during the ensuing washing, crude storage, separating, and refining processes.

Although RF dielectric heating systems have been used for heating hydrocarbon-bearing formations in the past, there remains a need for improved apparatuses and process techniques to rapidly, efficiently, and uniformly heat specific chemical compositions that reside in bitumen, and/or individual hydrocarbon compositions. There also is a substantial need for a method of separating the undesirable matter from the hydrocarbons and leaving it generally disposed in the context of its original environment.

Disadvantages of Capacitive RF Dielectric Heating

A specific disadvantage of known capacitive RF dielectric heating methods is the potential for thermal runaway or hot spots in a heterogeneous medium since the dielectric losses are often strong functions of temperature. Another disadvantage of capacitive heating is the potential for dielectric breakdown (arcing) if the electric field strengths are too high across the sample. Thicker samples with fewer air gaps allow operation at a lower voltage.

Prior Art

FIGS. 1–4 (Prior Art) show an example of a known capacitive RF dielectric heating system. A high voltage RF frequency sinusoidal AC signal is applied to a set of parallel electrodes 20 and 22 on opposite sides of a dielectric medium 24. Medium 24 to be heated is located between electrodes 20 and 22, in an area defined as the product treatment zone. An AC displacement current flows through medium 24 as a result of polar molecules in the medium aligning and rotating in opposite fashion to the applied AC electric field. Direct conduction does not occur. Instead, an effective AC current flows through the capacitor due to polar molecules with effective charges rotating back and forth. Heating occurs because these polar molecules encounter interactions with neighboring molecules, resulting in lattice and frictional losses as they rotate.

The resultant electrical equivalent circuit of the device of FIG. 1 is therefore a capacitor in parallel with a resistor, as shown in FIG. 2A. There is an in-phase $I_R$ component and an out-of-phase $I_C$ component of the current, relative to the applied RF voltage. In-phase component $I_R$ corresponds to the resistive voltage loss. These losses get higher as the frequency of the applied signal is increased for a fixed electric field intensity or voltage gradient due to higher speed interactions with the neighboring molecules. The higher the frequency of the alternating field, the greater the energy imparted into medium 24 until the frequency is so high that the rotating molecules can no longer keep up with the external field due to lattice limitations.

This frequency, which is referred to as a "Debye resonance frequency" after the mathematician who modeled it, represents the frequency at which lattice limitations occur. Debye resonance frequency is the frequency at which the maximum energy can be imparted into a medium for a given electric field strength (and therefore the maximum heating). This high frequency limitation is inversely proportional to the complexity of the polar molecule. For example, hydrocarbons with polar side groups or chains have a slower rotation limitation, and thus lower Debye resonance, than simple polar water molecules. These Debye resonance frequencies also shift with temperature as the medium 24 is heated.

FIGS. 2A, 2B, and 2C are equivalent circuit diagrams of the dielectric heating system of FIG. 1 for different types of hydrocarbon-bearing formations. Resultant electrical equivalent circuits may be different from the circuit shown in FIG. 2A, depending on the medium 24. For example, in a medium 24 such as a hydrocarbonaceous formation with a high moisture and salt content, the electrical circuit only requires a resistor (FIG. 2B), because the ohmic properties dominate. For media with low salinity and moisture, however, the resultant electrical circuit is a capacitor in series with a resistor (FIG. 2C).

Various other hydrocarbons, elements, or compositions within a hydrocarbon-bearing formation may use different electrical circuit analogs. More complex models having serial and parallel aspects in combination to address second order effects are possible. Any of the components in any of the models may have temperature and frequency dependence.

An example of a conventional RF heating system is shown in FIGS. 3 and 4. In this system, a high voltage transformer/rectifier combination provides a high-rectified positive voltage (5 kV to 15 kV) to the anode of a standard triode power oscillator tube. A tuned circuit (parallel inductor and capacitor tank circuit) is connected between the anode and grounded cathode of such tube as shown in FIG. 4, and also is part of a positive feedback circuit inductively coupled from the cathode to the grid of the tube to enable oscillation thereby generating the RF signal. This RF signal generator circuit output then goes to the combined capacitive dielectric and resistive/ohmic heating load through an adapter network consisting of a coupling circuit and a matching system to match the impedance of the load and maximize heating power delivery to the load, as shown in FIG. 3. An applicator includes an electrode system that delivers the RF energy to the medium 24 to be heated, as shown in FIG. 1.

The known system of FIGS. 1–4 can only operate over a narrow band and only at a fixed frequency, typically as specified by existing ISM (Industrial, Scientific, Medical) bands. Such a narrow operating band does not allow for tuning of the impedance. Any adjustment to the system parameters must be made manually and while the system is not operating. Also, the selected frequency can drift. Therefore, to the extent that the known system provides any control, such control is not precise, robust, real time or automatic.

BACKGROUND OF THE INVENTION—OBJECTS AND ADVANTAGES

Accordingly, several objects and advantages of the present invention are:

(a) to provide an improved method of hydrocarbon extraction;

(b) to provide a method to heat specific elements, chemical compositions, and/or specific hydrocarbons within the hydrocarbon-bearing formation utilizing a variable frequency automated capacitive radio frequency dielectric heating system;

(c) to provide in situ heat processing of hydrocarbonaceous earth formations utilizing a variable frequency automated capacitive radio frequency dielectric heating system, in such a manner that efficiently achieves substantially uniform heating of a particular bulk volume of the formations;

(d) to provide a system and method for efficiently heat processing relatively large blocks of hydrocarbonaceous earth formations with minimal adverse environmental impacts and for yielding a high net-energy ratio of energy recovered-to-energy expended;

(e) to provide a method to heat specific elements and compositions within a hydrocarbon-bearing formation, utilizing a variable frequency automated capacitive radio frequency dielectric heating system, while other elements and compositions within the formation are transparent to the frequencies being used to heat the targeted compositions.

Further objects and advantages are to provide a method to heat specific elements and compositions within a hydrocarbon-bearing formation, utilizing a variable frequency automated capacitive radio frequency dielectric heating system, which has the ability to heat specific elements and compositions within a formation, to separate foreign matter from desired hydrocarbons or other desirable substances within a subterranean environment, prior to above-ground extraction.

Further features and advantages of the invention will become more readily apparent from the following detailed description when taken in conjunction with the accompanying drawings.

SUMMARY

In accordance with the present invention an extraction and processing method of hydrocarbonaceous formations comprises an in situ heating process that utilizes a variable frequency automated capacitive radio frequency dielectric heating system, comprising an optional fluid carrier medium (for example, water or a saline solution), which can be unaffected, when desired, by the frequencies being presented to the target elements within the formation

DRAWINGS—FIGURES

FIG. 6 is a flow chart illustrating steps of impedance matching methods for use in the capacitive RF dielectric heating system diagrammed in FIG. 5.

DRAWINGS—REFERENCE NUMERALS

Figure 1:
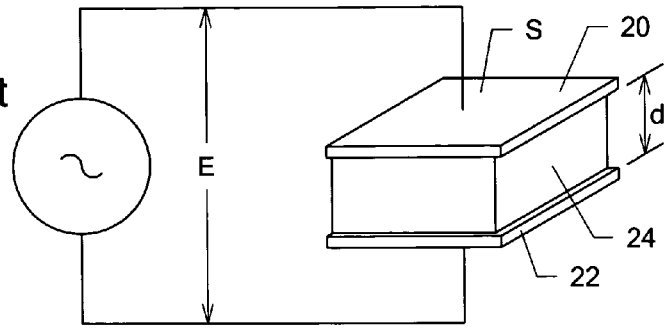
FIG. 1 Prior Art
FIG. 1 (Prior Art) is a schematic diagram of an existing capacitive RF dielectric heating system.

20 electrode
22 electrode
24 medium
26 fluid carrier medium

30 variable RF frequency signal generator
32 broadband linear power amplifier
34 tunable impedance matching network
35 voltage, current, and optional temperature measurement equipment
36 AC RF signal displacement current
38 computer
40 electrically-isolated electrode element
42 heat sensor
44 electrically-isolated electrode element
46 switch
120 electrode
122 electrode
124 medium
130 variable RF frequency signal generator
132 broadband linear power amplifier
133 connection between amplifier 132 and matching network 134
134 tunable impedance matching network
135 voltage, current, and optional temperature measurement equipment
136 AC RF power waveform
137*a* RF current probe
137*b* RF voltage probe
138 computer
150 tunable directional coupler
152 forward power measurement portion
154 reverse power measurement portion
156 measurement device
158 resonant cavity
159 capacitive coupling network
170 step: set signal generator 30 to an initial frequency or frequencies
172 step: measure temperature at medium
174 step: compare frequency(ies) and temperature
176 step: decide if change in frequency is required
178 step: change frequency, if needed
181 step: automatic impedance matching process
182 step: measure actual load impedance
184 step: tune out capacitive reactance
186 step: measure impedance match.
188 sub-step: measure forward and reflected powers
190 step: compare effective load impedance
192 step: adjust effective load impedance
193 step: automatic tuning of tunable impedance matching network
194 step: compare measured temperature
196 step: end of process
200 step: set signal generator 30 to an initial frequency or frequencies
208 step: automatic impedance matching process
210 step: measure actual load impedance
212 step: tune out reactance component of impedance
213 step: measure impedance match between signal generating unit and effective load
214 sub-step: measure forward and reverse powers
220 step: compare effective load impedance to impedance of signal generating unit
222 step: adjust effective load impedance
224 sub-step: automatic tuning of impedance matching network
225 control line
226 sub-step: change frequency, or frequencies of applied power waveform
228 step: compare monitored temperature with desired temperature
229 step: continue heating process, if necessary
230 step: end of process
301 well
302 overburden
304 medium (hydrocarbon-bearing formation)
306 bedrock or soil
308 reservoir of fluid carrier medium 320
310 derrick
315 radio waves
316 monitoring devices (data input sensors)
317 data transfer
318 frequency-emitting device
319 coaxial cable
320 fluid carrier medium
330 material being pumped to surface
332 reservoir
334 medium 304 being heated
335 main cavern
338 main reservoir
340 layer
342 layer
344 sediment
346 stratified layer
348 stratified layer
350 piping
352 piping
355 satellite cavern
356 stratified layer
358 stratified layer
360 stratified layer
362 stratified layer
364 dome cap
368 high-powered frequency-emitting device
370 process
372 remote underwater vessel
374 remote underwater vessel
376 process
377 slurry
378 location

DETAILED DESCRIPTION—FIGS. 5–10: CAPACITIVE RF DIELECTRIC HEATING

The electrical heating techniques disclosed below are applicable to various types of hydrocarbon-containing formations, such as oil shale, tar sands, coal, heavy oil, partially depleted petroleum reservoirs, etc. The relatively uniform heating which results from the following techniques, even in formations having relatively low electrical conductivity and relatively low thermal conductivity, provides great flexibility in applying recovery techniques. Accordingly, as will be described, the variable frequency automated capacitive radio frequency dielectric electrical heating of the present invention can be utilized either alone or in conjunction with other in situ recovery techniques to maximize efficiency for given applications.

I have devised a technique for uniform heating of relatively large blocks of hydrocarbonaceous formations using variable frequency automated capacitive radio frequency dielectric electrical heating that is substantially confined to the volume to be heated and effects dielectric heating of the formations. An important aspect of my invention relates to the fact that certain hydrocarbonaceous earth formations, for example unheated oil shale, exhibit dielectric absorption characteristics in the radio frequency range. Unlike most prior art electrical heating in situ approaches, the use of dielectric heating as disclosed below eliminates the reliance on electrical conductivity properties of the formations.

Capacitive Dielectric Vs. Ohmic

Capacitive dielectric heating differs from lower frequency ohmic heating in that capacitive heating depends on dielectric losses. Ohmic heating, on the other hand, relies on direct ohmic conduction losses in a medium and requires the electrodes to contact the medium directly. (In some applications, capacitive and ohmic heating are used together.)

Capacitive RF dielectric heating methods offer advantages over other electromagnetic heating methods. For example, such heating methods offer more uniform heating over the sample geometry than higher frequency radiative dielectric heating methods (e.g., microwaves), due to superior or deeper wave penetration into the sample and simple uniform field patterns. In addition, capacitive RF dielectric heating methods operate at frequencies low enough to use standard power grid tubes that are lower cost (for a given power level) and allow for generally much higher power generation levels than microwave tubes.

Capacitive RF dielectric heating methods also offer advantages over low frequency ohmic heating. These include the ability to heat a medium, such as medium 24, 124, or 304 shown in FIGS. 5, 7, or 12–16, that is surrounded by an air or fluid barrier (i.e., the electrodes do not have to contact the medium directly). The performance of capacitive heating is therefore also less dependent on the product making a smooth contact with the electrodes. Capacitive RF dielectric heating methods are not dependent on the presence of DC electrical conductivity and can heat insulators as long as they contain polar dielectric molecules that can partially rotate and create dielectric losses. A typical existing design for a capacitive dielectric heating system is described in "Electric Process Heating: Technologies/Equipment/Applications", by Orfeuil, M., Columbus: Battelle Press (1987).

Temperature Measurement: Past Vs. This Invention

Measuring of temperature in conjunction with dielectric heating in a hydrocarbon-bearing formation is not unique. However, in the past, temperature measurement was used as a more coarse form of process control, such as determining reservoir temperatures in various locations for modulation of generator power strength. In prior art, frequencies have been established with laboratory testing to determine an optimum frequency setting for the generator and even to predict frequency-setting adjustments that take into consideration changes in the environment. All prior processes using RF dielectric heating have heated the mass as a whole without the ability to manipulate the heating rates of specific chemical compositions within the formation.

Debye Frequencies

However, in a subterranean environment, it is novel to continuously measure dielectric properties, Debye frequencies in relationship to temperature, electrical conductivity of the formation, and/or electrical permittivity, and to use these measurements as parameters for near instantaneous tuning of frequency(s) to create rapid heating of specific chemical compositions within a hydrocarbon-bearing formation. The ability to rapidly heat specific elements or chemical compounds, hydrocarbon or otherwise, within a hydrocarbon-bearing formation provides a technological advance that will spawn unique hydrocarbon recovery and extraction process techniques.

The present methods and systems provide for improved overall performance and allow for more precise and robust control of the heating processes. With the new methods and systems, specific dielectric properties of hydrocarbons, elements, or chemical compositions within a bitumen deposit or other hydrocarbonaceous formation are determined and/or used in the process, either directly as process control parameters or indirectly as by reference to a model used in the process that includes relationships based on the properties. New ways of using capacitive RF dielectric heating in the various phases of heating hydrocarbon deposits and techniques to separate foreign matter prior to above surface extraction are disclosed. Two approaches are described below.

In the first approach, described in connection with the system shown in FIG. 5, a variable frequency RF waveform is generated. The waveform is output to an amplifier and an impedance matching network to generate an electric field to heat the hydrocarbon bearing matter. Based on at least the measured temperature of the hydrocarbons, elements, or compositions within the hydrocarbonaceous deposit and/or one or more of specific dielectric or ohmic properties of the same, the system is controlled to provide optimum heating. Multiple frequency power waveforms can be applied simultaneously.

Figure 7:
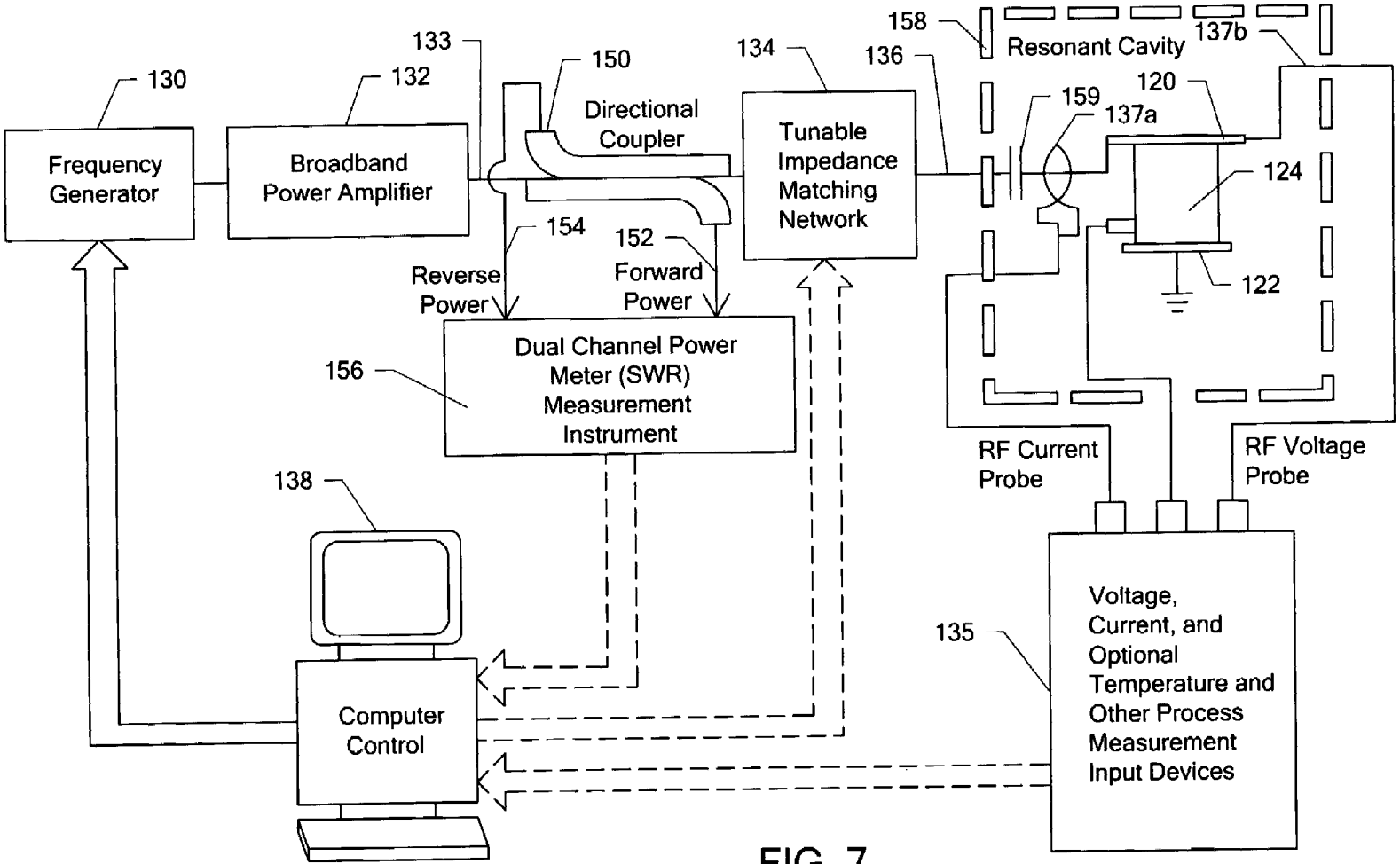
FIG. 7 is a block diagram similar to FIG. 5, except showing an alternative embodiment of a capacitive RF dielectric heating system.

In the second approach, which is described primarily in connection with the system of FIG. 7, enhanced feedback provides for automatic impedance matching. By matching the impedance, maximum power is supplied to the load, and the maximum heating rate is achieved. In general, achieving the highest possible heating rate is desirable because higher heating rates of specific hydrocarbons, elements, or compositions within a hydrocarbonaceous deposit will allow for separation techniques not currently possible. Specific implementations of each approach are discussed below, following sections on the characterization and monitoring of dielectric properties and impedance matching.

Characterization, Monitoring, and Modeling of Medium

Characterization of dielectric properties vs. frequency and temperature of medium 24, 124, or 304 assists in the design of a capacitive RF dielectric heating system to lower the viscosity of hydrocarbons, separate unwanted elements or compositions within a hydrocarbon bearing deposit, and extract the desirable hydrocarbons, elements, and/or compounds to the surface, by some methods of the present invention. Medium 24, 124, or 304 is hydrocarbonaceous material, which may include one or more of the following: hydrocarbons, kerogen, bitumen, oil shales, paraffin, waxes, and other chemical compositions such as sulfur. It is preferable to heat the hydrocarbonaceous matter at a sufficiently high temperature, while avoiding unnecessary hydrocarbon vaporization. Such heating should occur without boiling a fluid carrier medium 26 or 320 (FIGS. 5 and 12–16), as will be discussed elsewhere. Thus, to aid in the selection of appropriate operating conditions, tar sand bitumen, oil shale, and heavy oil samples are studied to assess the effects of RF energy on key properties of the hydrocarbons and associated elements, minerals, and other chemical compositions present in the deposit samples at various frequencies and temperatures. The results of these studies influence the design of capacitive dielectric heating systems.

An electromagnetic/heat transfer mathematical model can be used to predict the dielectric heating characteristics of various hydrocarbons and related formation substances. Such a model may involve 2-D and/or 3-D mathematical modeling programs as well as finite element methodologies to model composite materials. Best results are achieved with a model that integrates both electromagnetic and heat transfer principles.

To supply the alternating displacement current at a needed frequency, variable components of the tunable RF signal generator circuit and associated matching networks are actively tuned to change frequency, or tuned automatically, or switched with a control system. Therefore, a software control system is also provided to set up the frequency profile. A variable frequency synthesizer or generator and a broadband power amplifier and associated matching systems and electrodes are useful components of such a capacitive dielectric heating system. In some implementations, temperature monitoring of medium 24, 124, or 304 using thermal sensors such as sensors 42, 137*a*, 137*b*, and/or 316 or infrared scanners is conducted, the data is fed back into the control system, and the frequency groups from the generator are swept accordingly to track a parameter of interest, such as Debye resonances (explained below) or other dielectric property, or other temperature dependent parameters.

The key electromagnetic parameters of medium 24, 124, or 304 to be tested are defined as follows:

$\sigma$=Electrical Conductivity (S/m)

$\epsilon$=Electric Permittivity (F/m)

$\mu$=Magnetic Permeability (H/m)

E=RMS Electric Field Intensity (V/m)

H=RMS Magnetic Field Intensity (A/m)

B=Magnetic Flux Density (W/m$^2$)

Figure 2A:
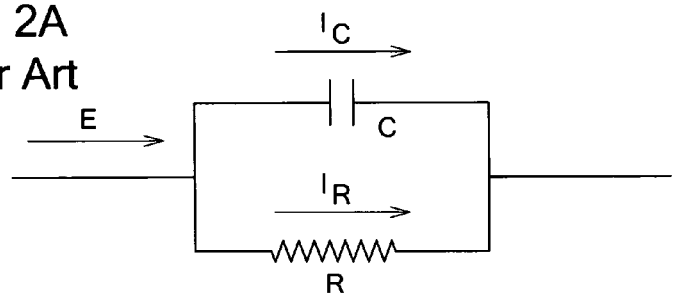
FIG. 2A Prior Art
FIGS. 2A, 2B and 2C (Prior Art) are equivalent circuit diagrams of the dielectric heating system of FIG. 1 for different types of hydrocarbon-bearing formations.
Figure 2B:
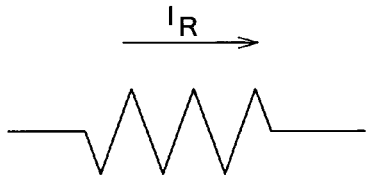
FIG. 2B Prior Art
Figure 2C:
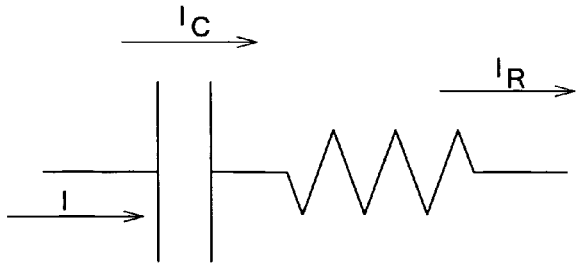
FIG. 2C Prior Art
Figure 3:
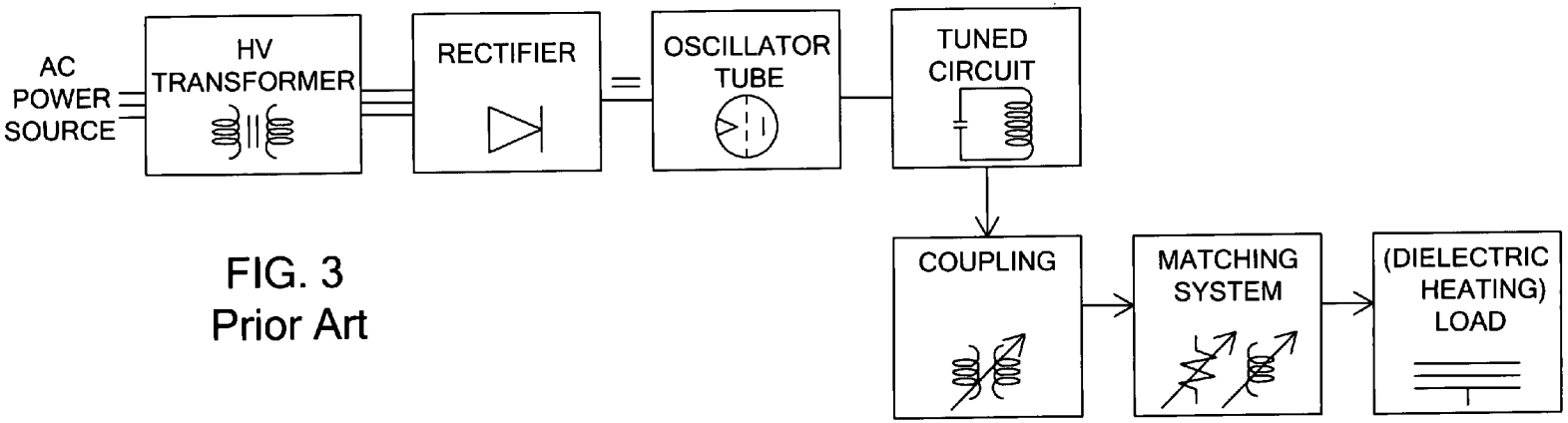
FIG. 3 Prior Art
FIG. 3 (Prior Art) is a block diagram of the dielectric heating system of FIG. 1.
Figure 4:
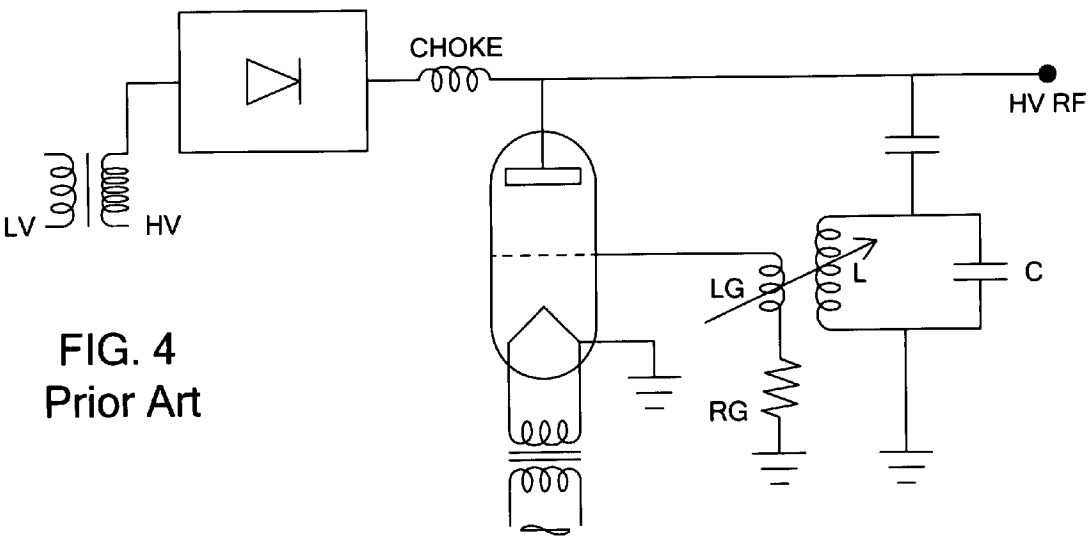
FIG. 4 Prior Art
FIG. 4 (Prior Art) is a block diagram showing the high power RF signal generation section of the dielectric heating system of FIG. 3 in greater detail.

The Permittivity and permeability can be divided into loss terms as follows:

$$\epsilon=\epsilon'-j\epsilon'' \quad (1)$$

$$\mu=\mu'-j\mu'' \quad (2)$$

where $j=\sqrt{-1}$ $\epsilon'$=Energy Storage Term of the Permittivity $\epsilon''$=Loss Term of the Permittivity $\mu'$=Energy Storage Term of the Permeability $\mu''$=Loss Term of the Permeability When analyzing the experimental data, the magnetic losses can be assumed equal to zero and for the most part frequency can be assumed high enough that the dielectric loss factor $\epsilon''$ dominates over losses due to electrical conductivity $\sigma$ (i.e., where $\omega\epsilon''>>\sigma$, with angular frequency $\omega=2\pi f$, f being the frequency measured in Hz). The electrical conductivity $\sigma$ is measured and accounted for where needed (mainly at the lower end of the frequency range). With those assumptions in mind, the expressions for equivalent capacitance and equivalent resistance in FIG. 2 reduce to the following:

$$C=(\epsilon' S)/d \quad (3)$$

$$R=d/(\omega\epsilon'' S), \quad (4)$$

where S is the exposed area of the plates and d is the plate separation between electrodes.

As mentioned above, capacitive heating systems according to the present invention operate at frequencies in the Medium Frequency (MF: 300 kHz–3 MHz) and/or High Frequency (HF: 3 MHz–30 MHz) bands, and sometimes stretch into the lower portions of the Very High Frequency (VHF: 30 MHz–300 MHz) band. The frequency is generally low enough that the assumption can be made that the wavelength of operation is much larger than the dimensions of the hydrocarbonaceous deposit medium 24, 124, or 304, thus resulting in highly uniform parallel electric field lines of force across the components of medium 24, 124, or 304 and/or fluid carrier medium 26 or 320 targeted for heating.

Impedance Matching

Electrical impedance is a measure of the total opposition that a circuit or a part of a circuit presents to electric current for a given applied electrical voltage, and includes both resistance and reactance. The resistance component arises from collisions of the current-carrying charged particles with the internal structure of a conductor. The reactance component is an additional opposition to the movement of electric charge that arises from the changing electric and magnetic fields in circuits carrying alternating current. With a steady direct current, impedance reduces to resistance.

As used here, input impedance is defined as the impedance looking into the input of a particular component or components, whereas output impedance is defined as the impedance looking back into the output of the component or components.

The heating load, or, more formally, the actual load, is the combination of medium 24, 124, or 304 (i.e., the hydrocarbonaceous substances, other specific compositions natural to the formation, and /or water), fluid carrier medium 26 or 320 (if used), and exposed formation, e.g., capacitive electrodes 20, 22, 318 and any electrode enclosure that may be present. Thus, as used here, the actual load impedance is the input impedance looking into the actual load. The impedance of medium 24, 124, or 304 is influenced by its ohmic and dielectric properties, which may be temperature dependent. Thus, the actual load impedance typically changes over time during the heating process because the impedance of medium 24, 124, or 304 varies as the temperature changes.

The effective adjusted load impedance, which is also an input impedance, is the actual load impedance modified by any impedance adjustments. In specific implementations, impedance adjustments include the input impedance of a tunable impedance matching network coupled to the load and/or the input impedance of a coupling network coupled to the structure surrounding the load (e.g., the electrodes and/or enclosure, if present). In these implementations, the effective load includes the impedance load of any impedance adjusting structures and the actual load. Other impedance adjustments that may assist in matching the effective adjusted load impedance to the output impedance of the signal generating unit may also be possible. The effective load impedance is the parameter of interest in the present impedance matching approach.

The signal-generating unit, as used here, refers to the component or components that generate the power waveform, amplify it (if necessary), and supply it to the load. In specific implementations, the signal-generating unit includes a signal generator, an amplifier that amplifies the signal generator output and conductors, e.g. a coaxial cable, through which the amplified signal generator output is provided to the load.

The signal generating unit's impedance that is of interest is its output impedance. In specific implementations, the output impedance of the signal generating unit is substantially constant within the operating frequency range and is not controlled. Both the input impedance and the output impedance of the power amplifier, as well as the signal generator out impedance and the conductor characteristic impedance are substantially close to 50 ohms. As a result, output impedance of the signal-generating unit is also substantially close to 50 ohms.

Thus, in specific implementations, matching the effective adjusted load impedance to the output impedance of the signal generating unit reduces to adjusting the effective adjusted load impedance such that it "matches" 50 ohms. Depending upon the circumstances, a suitable impedance match is achieved where the effective adjusted load impedance can be controlled to be within 25 to 100 ohms, which translates to nearly 90% or more of the power reaching the actual load.

Impedance matching is carried out substantially real-time, with control of the process taking place based on measurements made during the process. Impedance matching can be accomplished according to several different methods. These methods may be used individually, but more typically are used in combination to provide different degrees of impedance adjustment in the overall impedance matching algorithm.

The frequency of the signal generator may be controlled. In an automated approach, the signal generator frequency is automatically changed based on feedback of a measured parameter. For example, the signal generator frequency may be changed based on the actual load temperature and predetermined relationships of frequency vs. temperature. The frequency may be changed to track Debye resonances as described above and/or to maintain an approximate impedance match. Typically, this serves as a relatively coarse control algorithm.

For more precise control, aspects of the power waveform supplied to the effective load can be measured, fed back and used to control the frequency. For example, the forward power supplied to the effective load and the reverse power reflected from the effective load can be measured, and used in conjunction with measurements of the actual voltage and current at the load to control the frequency.

A tunable matching network can be automatically tuned to adjust the effective load impedance to match the output impedance of the signal generating unit. In a first step, series inductance is used in the output portion of the impedance matching network to tune out the series capacitive component of the actual load impedance. The series inductance is set by measuring the initial capacitive component, which is determined by measuring the voltage and current at the actual load and determining their phase difference. It is also possible to measure the voltage and current within the matching network and control for a zero phase shift. For more complex models of the load, other models will be necessary. An alternative approach would be to use a shunt inductor to tune out a shunt capacitive load.

Changes in the dielectric properties with heat directly influence the intensity and phase relationship of the RF wave energy. Measurements of these two parameters during the process can be related to corresponding changes of the physical properties of the material being processed. Initially, the resulting effective load impedance will be purely resistive, but will likely differ from the desired 50-ohm level. In a second step, additional elements within the matching network are tuned to make the input impedance of the matching network, which is defined as the effective adjusted load impedance for a described implementation, match the desired 50-ohm target. The second step tuning is controlled based on the measured forward and reflected power levels.

It is possible to adjust the gap in a capacitive coupling network positioned at the load. Such adjustments could be made automatically during the heating process with a servo a motor. It is possible to physically adjust the capacitive electrodes that are included as a part of the actual load to make minor adjustments to the actual load impedance. (Other adjustments are likely more easily controlled.)

Specific implementations that incorporate impedance matching are discussed in the following sections that detail two approaches.

Figure 5:
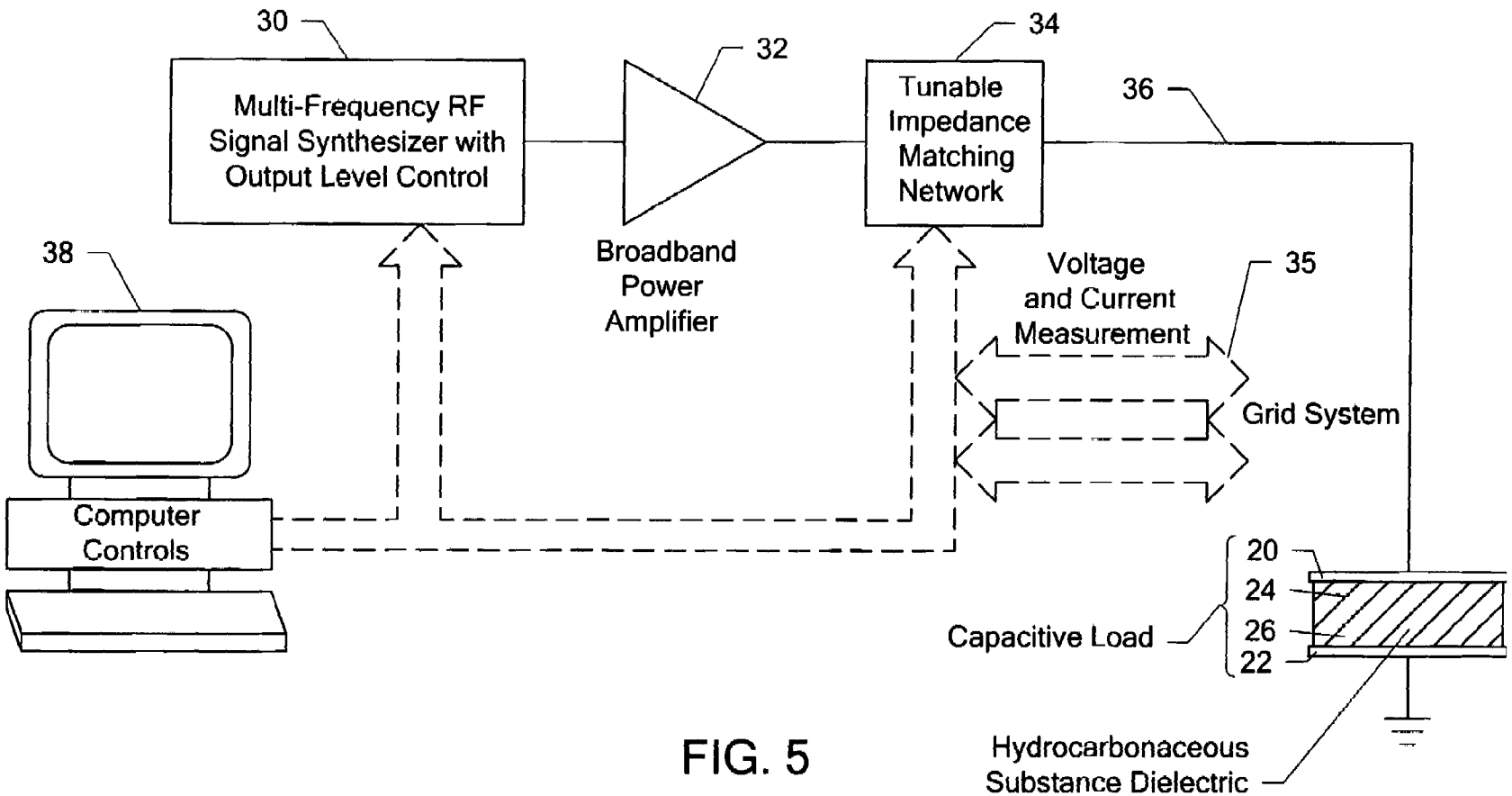
FIG. 5 is a block diagram of a capacitive RF dielectric heating system in accordance with the invention.

FIG. 5: First Approach—Matching Impedance Using Temperature Measurements

One exemplary system suitable for the first approach, in which at least the measured temperature of the hydrocarbonaceous substance(s), specific chemical compositions, and/or hydrocarbons targeted for heating is monitored, is shown in FIG. 5. The system of FIG. 5 includes a variable RF frequency signal generator 30 with output voltage level control, a broadband linear power amplifier 32, and a tunable impedance-matching network 34 (for fixed or variable frequency operation) to match the power amplifier output impedance to the load impedance of the capacitive load, which includes electrodes 20 and 22 and medium 24, and may or may not contain fluid carrier medium 26 being optionally heated. Medium 24 in this application is hydrocarbonaceous material, which may include one or more of the following: hydrocarbon compositions, kerogen, crude bitumen, oil bearing shales, paraffin, waxes, and other chemical compositions that naturally reside in these deposits such as sulfur. Fluid carrier medium 26 preferably is generally a liquid such as water, a saline solution, or de-ionized water, but other fluids could be used such as natural gas, nitrogen, carbon dioxide, and flue gas.

The system is constructed to provide an alternating RF signal displacement current 36 at an RF frequency in the range of 300 kHz to 300 MHz. This range includes the MF (300 kHz to 3 MHz), HF (3 MHz to 30 MHz), and VHF (30 MHz to 300 MHz) frequencies in the lower regions of the radio frequency (RF) range.

In the specific implementation shown in FIG. 5, variable RF frequency signal generator 30 is a multi-RF frequency signal generator capable of simultaneously generating multiple different frequencies. Although a single frequency signal generator may be used, the multi-frequency signal generator is useful for methods in which frequency-dependent dielectric properties of specific compositions and/or hydrocarbons targeted for heating are monitored and used in controlling the heating process, such as is explained in the following section.

Debye Resonance Frequency Implementations

As one example, the energy efficiency and/or heating rate are maximized at or near the location in frequency of the "Debye resonance" (defined earlier) of medium 24. In other specific implementations, dielectric properties other than Debye resonances are tracked and used in controlling capacitive RF dielectric heating, e.g., when Debye resonances are not present or are not pronounced. These other dielectric properties may be dependent upon frequency and/or temperature, similar to Debye resonances, but may vary at different rates and to different extents. Examples of such other dielectric properties are electrical conductivity and electrical permitivity.

In this example, the RF signal frequency is tuned to the optimal Debye frequency or frequencies of targeted media 24 for heating hydrocarbons and/or chemical compositions that reside in hydrocarbonaceous material. Multiple Debye resonances may occur in a composite material. So, multiple composite frequency groups can be applied to handle the several Debye resonances. Also, the RF signal frequencies can be varied with temperature to track Debye frequency shifts with changes in temperature.

The RF frequency or composite signal of several RF frequencies is selected to correlate with the dominant Debye resonance frequency groups of medium 24 that is being heated. These Debye resonances are dependent on the polar molecular makeup of medium 24 and thus are researched for different types of hydrocarbon compounds, and/or specific chemical compositions or elements that reside in hydrocarbonaceous deposits, to appropriately program the heating system. The generation system, in this case variable RF frequency signal generator 30, is capable of generating more than one frequency simultaneously. The control system for this heating system is capable of being calibrated for optimal efficiency to the various hydrocarbons or chemical compositions that are targeted for heating.

The frequency or composite frequency groups of the RF signal used in the heating system will track with and change with temperature to account for the fact that the Debye resonance frequencies of the polar molecular constituents of the hydrocarbonaceous material or other targeted medium 24 also shift with temperature.

With the most preferred apparatuses, the RF signal power level and resulting electric field strength can be adjusted automatically by a computer control system which changes the load current to control heating rates and account for different hydrocarbon geometries and bitumen, oil shale, or heavy oil compositions. The power level is controlled by: (1) measuring the current and field strength across the actual load with voltage and current measurement equipment 35 (FIG. 5); and (2) adjusting the voltage (AC field strength), which in turn varies the current, until measurements of the current and field strength indicate that the desired power level has been achieved. As shown in FIG. 5, computer 38 also controls multi-frequency RF signal synthesizer 30 to change its frequency and to adjust the tunable impedance matching network 34.

FIG. 6: Flowchart for First Approach

FIG. 6 is a flowchart showing a heating process according to the first approach in more detail. In step 170, signal generator 30 is set to an initial frequency or frequencies. For expository convenience, it is assumed in this example that a single frequency is set, but the description that follows applies equally to cases where multiple frequencies are set.

The set frequency may be selected with reference to a predetermined frequency or frequency range based on a known relationship between frequency and temperature. For example, the set frequency may be selected based on one or more Debye resonances of the medium 24 as described above.

In step 172, the temperature at medium 24 is measured. In step 174, the measured temperature and set frequency are compared to a predetermined relationship of frequency and temperature for medium 24. The relationship may be stored in computer 38, e.g., in the form of a look-up table.

If the comparison between the set frequency and the predetermined frequency indicates that the set frequency must be changed (step 176; YES), the process advances to step 178, the set frequency is automatically changed by control signals sent to signal generator 30, and step 174 is repeated. If no change in the set frequency is required (step 176; NO), the process advances.

As indicated by the dashed line, an automatic impedance matching process 181 follows step 176. For an exemplary implementation, automatic impedance matching begins with step 182. In step 182, the magnitude and phase of the actual load impedance are measured using voltage and current measurement equipment 35, and the measured values are relayed to computer 38. In step 184, the phase angle difference between the measured voltage and current is determined to tune out the reactance component of the impedance. One element of controlling impedance match is, therefore, to tune out the capacitive reactance component of the actual load resulting in zero phase shifts between the voltage and current.

In step 186, the impedance match between the signal generating unit and the effective load is measured. Optionally, impedance match can be controlled through measuring the power waveforms supplied to and reflected from the effective load (the "forward and reverse powers") (optional sub-step 188), assuming the system of FIG. 5 is configured to include a measurement instrument 156 and directional coupler 150 as shown in FIG. 7, which will be discussed later. (Measurement of the forward and reverse powers is described in the following section.) Following completion of step 186, the process advances to step 190. In step 190, the effective load impedance is compared to the predetermined impedance of the signal-generating unit. If the impedance match is not sufficient, the process proceeds to step 192. If the impedance match is sufficient, the process proceeds to step 194.

In step 192, the effective load impedance is adjusted. In the implementation of the approach of FIG. 5, the effective load impedance is adjusted by automatically tuning tunable impedance matching network 34 based on control signals sent from computer 38 (step 193). Following step 192, the process returns to step 186.

In step 194, the measured temperature is compared to a desired final temperature. If the measured temperature equals or exceeds the desired final temperature, the heating process in completed (step 196). Otherwise, heating is continued and the process returns to step 172.

Heating hydrocarbons or other targeted elements or specific chemical compositions can be rapidly achieved. The rapid heating capability is due to the same uniform heating advantage described above and the maximum power input to the heated load by the matching of generator frequency or composite of frequencies to the Debye resonance frequency groups of the targeted compositions that reside in hydrocarbon-bearing formations 304, and tracking those Debye resonance frequency groups with temperature. Power control capability of the generator/heating system allows for the ability to set heating rates to optimize heating processes.

In some implementations, higher overall energy efficiency is obtained by matching the generator frequency or composite of frequencies of the RF waveform to the Debye resonance frequency groups of the specific compositions that reside in hydrocarbonaceous formations and by tracking those resonances with temperature resulting in a shorter heating time per unit volume for a given energy input.

Complete control of the heating process is achieved by the selective heating of various constituents of medium 24, including the bitumen, hydrocarbons, and/or other targeted compositions. Hydrocarbon molecules often are polar. In addition, various compositions that reside in hydrocarbonaceous formations can also be polar. For example, in implementations where Debye resonances are monitored, this technology can be set up to target the Debye resonances of those constituents of hydrocarbon for which heating is desired and avoid the Debye resonances of other constituents (e.g., water, sulfur, sand, shale, other hydrocarbonaceous related substances) of which heating is not desired by setting the generator frequency or frequency groups of the RF waveform to target the appropriate Debye resonances and track them with temperature and avoid other Debye resonances. There could also be instances where the opposite is desired to achieve a process objective such as targeting the Debye resonances of the undesired constituents (e.g., water, sulfur, sand, shale, organic substances) for heating while avoiding or controlling the heating of the desired hydrocarbons.

The matching of the generator frequency or composite of frequencies of the RF waveform to the Debye resonance frequency groups of the various heated media, and tracking those Debye resonance frequency groups with temperature or other sensory inputs, can increase heating rates.

Overall energy efficiency is improved due again to the matching of the generator frequency or composite of frequencies to the Debye resonance frequency groups of the various heated media and tracking those Debye resonance frequency groups with temperature. Efficiency is also improved by selective heating of the various individual constituents of medium 24 (e.g., hydrocarbons without affecting the other chemical compositions) by targeting the Debye resonance profiles of those constituents and setting up the generator to excite them and track them with temperature or other sensory inputs.

The characterization of the dielectric properties of hydrocarbons as a function of frequency and temperature and the search for Debye resonances of the various hydrocarbon constituents are of great interest. If sufficient information is available, the heating apparatus can be programmed with great precision. Such information can be obtained by conducting preliminary experiments on the specific compositions (both desired and undesirable constituents) that reside in hydrocarbonaceous formations.

Examples are presented later for testing aspects of the first approach.

FIG. 7: Second Approach—Matching Impedance Using Enhanced Feedback and Automatic Controls According to the second approach, enhanced feedback and automatic control are used to match the effective adjusted load impedance with the output impedance of a signal generating unit that produces an amplified variable frequency RF waveform.

The system of FIG. 7 is similar to the system of FIG. 5, except that the system of FIG. 7 provides for direct measurement of the power output from the amplifier, and this result can be used to match the load impedance to the output impedance of the signal generating unit, as is described in further detail below. Specifically, the system of FIG. 7 provides for measuring the forward and reflected power, as well as the phase angle difference between the voltage and the current.

Also, the temperature of medium 124 during the process is not used as a variable upon which adjustments to the process are made, although it may be monitored such that the process is ended when a desired final temperature is reached. Elements of FIG. 7 common to the elements of FIG. 5 are designated by the FIG. 5 reference numeral plus 100. For example, medium 124 in FIG. 7 is the same as medium 24 in FIG. 5.

Similar to FIG. 5, FIG. 7 shows a variable RF frequency generator 130 connected to a broadband linear power amplifier 132, with amplifier output 133 being fed to a tunable impedance matching network 134. As in the case of amplifier 32, amplifier 132 is a 2 kW linear RF power amplifier with an operating range of 10 kHz to 300 MHz, although a 500 W–100 kW amplifier could be used. Positioned between amplifier 132 and matching network 134 is a tunable directional coupler 150 with a forward power measurement portion 152 and a reverse power measurement portion 154.

Tunable directional coupler 150 is directly connected to amplifier 132 and to matching network 134. Forward and reverse power measurement portions 152 and 154 are also each coupled to connection 133 (which can be on a coaxial transmission line) between amplifier 132 and matching network 134 to receive respective lower level outputs proportional to forward and reverse power transmitted through connection 133. These lower level outputs, which are at levels suitable for measurement, can be fed to a measurement device 156. If a 25 W sensor is used in each of forward and reverse power measurement portions 152 and 154, the measurement capability for forward and reverse power will be 2.5 kW with a coupling factor of −20 dB. Measurement device 156 allows a voltage standing wave ratio (SWR) to be measured. The voltage SWR is a measure of the impedance match between the signal generating circuitry output impedance and the effective load impedance.

As described above, matching network 134 can be tuned to produce an impedance adjustment such that the effective adjusted load impedance matches the signal generating circuitry output impedance. A voltage SWR of 1:1 indicates a perfect match between the signal generating circuitry output impedance and the effective load impedance, whereas a higher voltage SWR indicates a poorer match. As alluded to above, however, even a voltage SWR of 2:1 translates into nearly 90% of the power reaching the load.

Measurement device 156 can also determine the effective load reflection coefficient, which is equal to the square root of the ratio of the reverse (or reflected) power divided by the forward power. In specific implementations, measurement device 156 can be an RF broadband dual channel power meter or a voltage standing wave ratio meter.

Alternatively or in addition to the methods described above, it is also possible to control heating by controlling for a minimum reflected power, e.g., a reflected power of about 10% or less of the forward power.

Similar to FIG. 5, an AC RF power waveform 136 is fed from matching network 134 to the load, which includes electrodes 120 and 122 and a medium 124 to be heated in the product treatment zone between electrodes 120 and 122. As in FIG. 5, the system of FIG. 7 includes voltage and current measurement equipment 135, to measure the voltage applied across the capacitive load and current delivered to the capacitive load, which can be used to determine load power and the degree of impedance match. The voltage, current, and optional temperature measurement devices 135 includes inputs from an RF current probe 137*a*, which is shown as being coupled to the connection between network 134 and electrode 120, and an RF voltage probe 137*b*, which is shown as being connected (but could also be capacitively coupled) to electrode 120. As indicated, there may be an additional sensor for measuring the temperature or other suitable environmental parameter at the medium 124. Superior results are achieved with probes 137*a* and 137*b* that are broadband units, and voltage probe 137*b* that has a 1000:1 divider. A capacitively coupled voltage probe with a divider having a different ratio can also be used.

The voltage and current measurements are also used in determining the effect of capacitive reactance. Capacitive reactance in a circuit results when capacitors or resistors are connected in parallel or series, and especially when a capacitor is connected in series to a resistor. The current flowing through an ideal capacitor is −90 degrees out of phase with respect to an applied voltage. By determining the phase angle between the voltage and the current, the capacitive reactance can be "tuned out" by adjusting tunable network 134. Specifically, inductive elements within an output portion of tunable matching network 134 are tuned to tune out the capacitive component of the load.

Signals from probes 137*a* and 137*b* indicate the current delivered to the capacitive load and voltage applied across the load, respectively, to computer 138. Measurement equipment 135 includes a computer interface that processes the signals into a format readable by computer 138. The computer interface may be a data acquisition card, and it may be a component of a conventional oscilloscope. If an oscilloscope is used, it can display one or both of the current and voltage signals, or the computer may display these signals.

The system of FIG. 7 includes feedback control as indicated by the arrows leading to and from computer 138. Based on input signals received from measurement instrument 156, measurement equipment 135, and algorithms processed by computer 138, control signals are generated and sent from computer 138 to frequency generator 130 and matching network 134.

The control algorithm executed by the computer may include one or more control parameters based on properties of hydrocarbonaceous medium 24, specific chemical compositions, and/or hydrocarbons in medium 24, or a fluid carrier medium 320 (as will be discussed elsewhere), targeted for heating, as well as the measured load impedance, current, voltage, forward and reverse power, etc. For example, the algorithm may include impedance vs. temperature information for a specific hydrocarbon composition such as butane as a factor affecting the control signal generated to change the frequency and/or to tune the impedance matching network.

Figure 8:
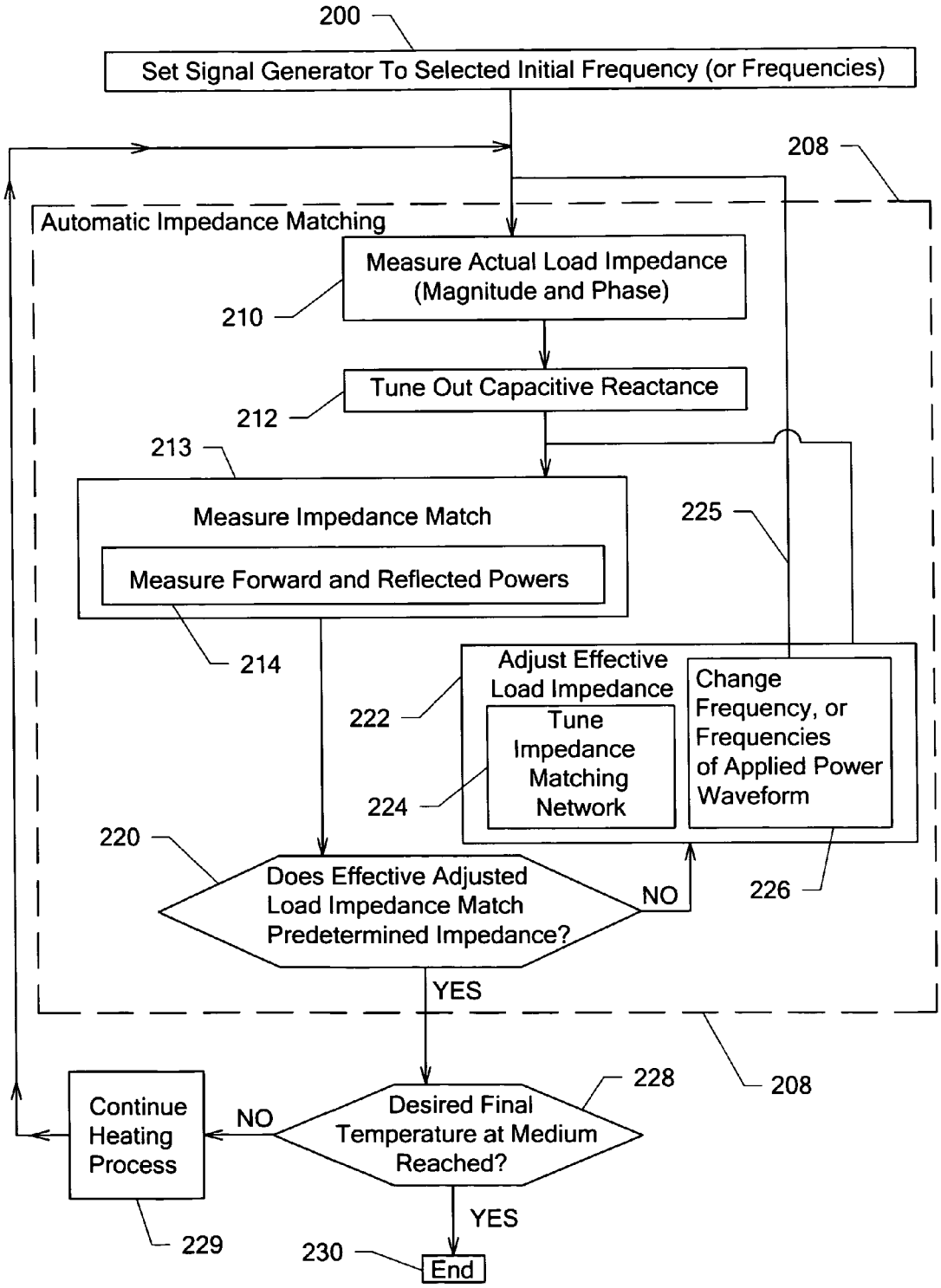
FIG. 8 is a flow chart illustrating steps of impedance matching methods for use in the capacitive RF dielectric heating system diagrammed in FIG. 7.

FIG. 8: Flowchart for Second Approach

FIG. 8 is a flowchart illustrating steps of capacitive RF heating methods using impedance matching techniques. In step 200, the signal-generating unit is set to an initial frequency, which, as in the case of step 170 in FIG. 6, may be based on a predetermined frequency vs. temperature relationship, and the heating process is initiated.

As indicated by the dashed line, an automatic impedance matching process 208 follows step 200. For an exemplary implementation, automatic impedance matching begins with step 210. In step 210, the magnitude and phase of the actual load impedance are measured using the voltage and current measurement equipment 135, and the measured values are relayed to the computer 138. In step 212, the phase angle difference between the measured voltage and current is determined to tune out the reactance component of the impedance.

In step 213, the impedance match between the signal generating unit and the effective load is measured. For this implementation, measuring the impedance match includes measuring the forward and reverse powers (sub-step 214), and a voltage SWR is calculated as described above. The calculated voltage SWR is fed back to computer 138.

In step 220, the effective load impedance is compared to the impedance of the signal-generating unit, which is a constant in this example. If the match is not sufficient, e.g., as determined by evaluating the voltage SWR, the process proceeds to step 222. If the impedance match is sufficient, the process proceeds to step 228.

In step 222, the effective load impedance is adjusted. As described above, adjusting the effective load impedance, i.e., raising or lowering it, may be accomplished in two ways. As shown in sub-step 224, the impedance matching network (e.g., network 134) can be tuned to produce an impedance adjustment such that the effective adjusted load impedance matches the output impedance of the signal generating unit. As an alternative to, or in conjunction with sub-step 224, the frequency at which the RF waveform is applied can be changed (sub-step 226) to cause a change in the effective adjusted load impedance. If the frequency is changed, it may be necessary to tune out the capacitive reactance again by repeating steps 210 and 212, as indicated by the control line 225 leading from sub-step 226 to step 210, before reaching step 213. If step 222 involves only tuning the impedance matching network, the process can return directly to step 213.

Step 228 is reached following a determination that an acceptable impedance match exists. In step 228, a monitored temperature is compared to a desired final temperature. If the measured temperature equals or exceeds the desired final temperature, the heating process is completed (step 230). Otherwise, heating is continued (step 229) and the process returns to step 210.

The feedback process of steps 210, 220, and 222 continues at a predetermined sampling rate, or for a predetermined number of times, during the heating process. In specific implementations, the sampling rate is about 1–5 s. Thus, as the targeted constituents are heated, the change in effective adjusted load impedance is periodically monitored and automatically adjusted to the constant output impedance of the signal generating unit, thereby ensuring that maximum power is used to heat the desired substance. As a result, the hydrocarbon or other specific entity is heated quickly and efficiently.

The measured temperature may be used as an added check to assist in monitoring the heating process, as well as for establishing temperature as an additional control parameter used in controlling the process, either directly or with reference to temperature-dependent relationships used by the control algorithm.

To permit operation of the system on non-ISM (Industrial, Scientific and Medical) RF bands, shielding can be used to isolate various components of the system from each other and the surrounding environment. For example, as shown schematically in FIG. 7, a resonant cavity 158 can be provided to shield the capacitive load and associated circuitry from the surroundings. Other components may also require shielding. Shielding helps prevent interference. Even though the frequency changes during the heating process, it resides at any one frequency value long enough to require shielding. An alternative approach is to use dithering (varying the frequency very quickly so that it does not dwell and produce sensible radiation) or spread the spectrum to reduce the shielding requirement.

As shown in FIG. 7, a secondary impedance matching device, e.g., a capacitive coupling network 159 is connected in series between network 134 and electrode 120. Varying the capacitance of the capacitance coupling network aids in impedance matching.

A conventional servo motor (not shown) may be connected to the capacitor-coupling network to change its capacitance. The servo motor may be connected to receive control signals for adjusting the capacitance from computer 138. Generally, capacitance-coupling network 159 is used for relatively coarse adjustments of load impedance.

A network analyzer (not shown) may also be used in determining impedance levels. Usually, the network analyzer can only be used when the system is not operating. If so, the system can be momentarily turned off at various stages in a heating cycle to determine the impedance of the capacitive load and the degree of impedance matching at various temperatures.

Figure 9:
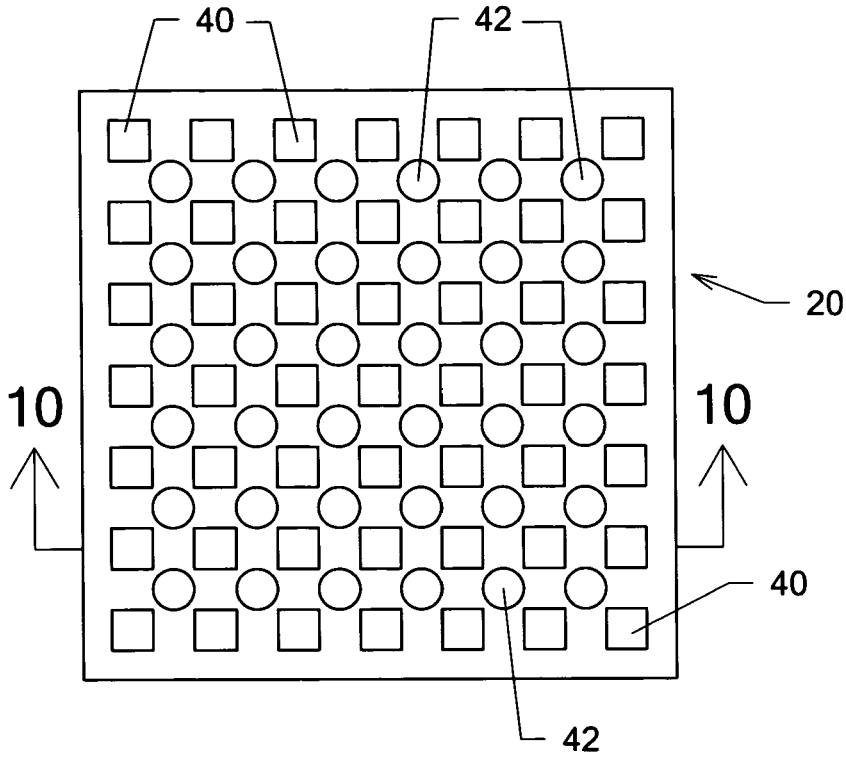
FIG. 9 is a top plan view of a grid electrode, which may be used in the systems of FIGS. 5 and 7.
Figure 10:
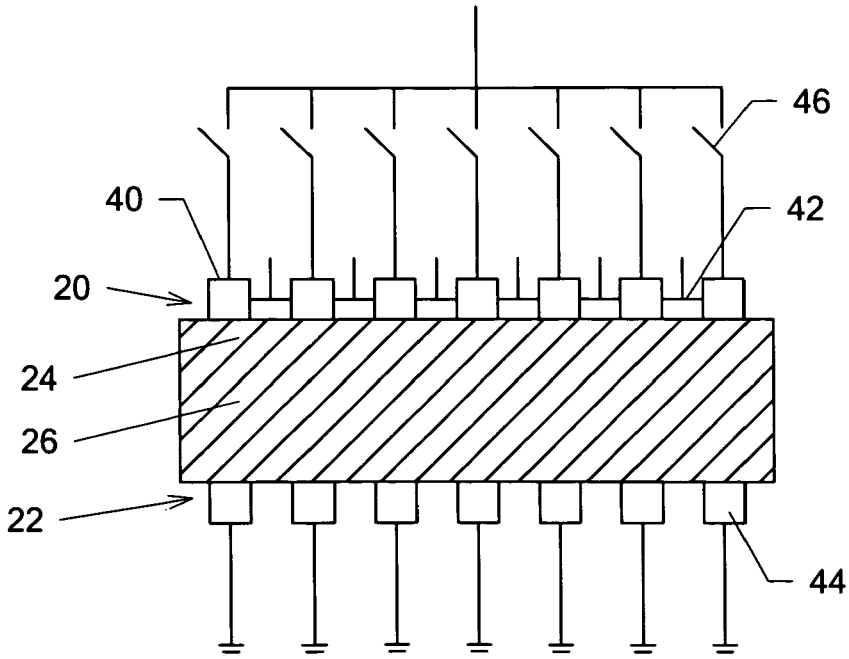
FIG. 10 is a sectional view taken along line 10—10 of FIG. 9.

FIGS. 9 and 10: Electrode Construction

As shown in FIGS. 9 and 10, the systems of FIGS. 5 or 7 can employ gridded heating electrodes on the capacitive load for precise control of heating of medium 24 by computer 38, especially to assist with heating heterogeneous media. At least one of the electrodes, for example top electrode 20 (FIGS. 9 and 10) has a plurality of electrically isolated electrode elements 40, such as infrared thermal sensors or other input devices. Bottom electrode 22 also has a plurality electrically isolated electrode elements 44. Most favorably, each top electrode element 40 is located directly opposite a corresponding bottom electrode element 44 on the other electrode. A plurality of switches 46, under control of the computer 38, are provided to selectively turn the flow of current on and off between opposing pairs of electrode elements 40 and 44. And/or, an individual computer-controlled variable resistor (not shown) can be included in the circuit of each electrode pair, connected in parallel with the load, to separately regulate the current flowing between the elements of each pair. These arrangements provide the ability to heat individual areas of a hydrocarbon-bearing formation 304, or of an artificially created cavern reservoir 335 of medium 24, 304 or with fluid carrier medium 26, 320 (as will be discussed elsewhere) at different rates than others. These arrangements also protect against thermal runaway or "hot spots" by switching out different electrode element pairs for moments of time or possibly providing different field strengths to different portions of the formation or stratification.

It is also advantageous to provide one or more heat sensors on at least one of the electrodes 20 and 22. FIGS. 9 and 10 show a compact arrangement where multiple spaced heat sensors 42 are interspersed between electrode elements 40 of top electrode 20. Thermal sensors 42 acquire data about the temperatures of the targeted chemical compositions that reside in hydrocarbonaceous matter medium 24 at multiple locations. This data is sent as input signal to computer 38. The computer uses the data from each sensor to calculate any needed adjustment to the frequency and power level of the current flowing between pairs of electrode elements located near the sensor. The corresponding output control signals are then applied to RF signal generator 30, network 34, and switches 46.

Electrodes 20 and 22 are preferably made of an electrically conductive and non-corrosive material, such as stainless steel or gold that is suitable for use in a subterranean environment. Electrodes 20 and 22 can take a variety of shapes depending on the shape and nature of the hydrocarbon-bearing formation or the artificially created cavern. Although FIGS. 9 and 10 show a preferred embodiment of the electrodes, other arrangements of electrode elements and sensors could be used with similar results or for special purposes.

Measuring and Characterizing Dielectric Properties

Tests can be conducted to measure and characterize dielectric properties, including Debye resonances, of various constituents of hydrocarbonaceous matter, as functions of frequency (100 Hz–100 MHz) and temperature (0–500° C.).

The procedure detailed below is for measuring the impedance (parallel capacitor and resistor model) of specific hydrocarbon compositions or other chemical constituents that reside in the formation. A sample is sandwiched in a parallel electrode test fixture within a controlled temperature/humidity chamber. The equipment used for this procedure is as follows:

| | |
|---|---|
| HP 4194A: | 100 Hz–100 MHz Impedance/Gain-Phase Analyzer |
| HP 41941A: | 10 kHz–100 MHz RF Current/Voltage Impedance Probe |
| HP 16451B: | 10 mm, 100 Hz–15 MHz Dielectric Test Fixture for 4-Terminal Bridge |
| HP 16453A: | 3 mm, 100 Hz–100 MHz RF/High Temperature Dielectric Test Fixture |
| Damaskos Test, Inc: | Various specially-designed fixtures |
| Dielectric Products Co.: | 9 mm, 100 Hz–1 MHz Sealed High Temperature Semi-Solids LD3T Liquid-Tight Capacitive Dielectric Test Fixture |
| HP 16085B: | Adapter to mate HP16453A to HP 4194A 4-Terminal Impedance Bridge Port (40 MHz) |
| HP 16099A: | Adapter to mate HP16453A to HP 4194A RF IV Port (100 MHz) |
| Temperature/ Humidity Chamber: | Thermotron Computer Controlled Temperature/Humidity Chamber −68–+177° C., 10%–98% RH, with LN2 Boost for cooling |

Each of the capacitive dielectric test fixtures is equipped with a precision micrometer for measuring the thickness of the sample, which is critical in calculating the dielectric properties from the measured impedance. The different test fixtures allow for trading off between impedance measurement range, frequency range, temperature range, sample thickness, and compatibility with hydrocarbonaceous matter.

Various samples of hydrocarbon bearing deposits are prepared to have water and salt contents representative of naturally occurring circumstances. Three different moisture and salt content values, including an upper- and lower-range value and a mid-range value, are chosen for the samples. A minimum of four replications of each specific hydrocarbon composition is tested with each dielectric probe for a total of twelve test cases for each composition. Different groups of 4 replicated samples are prepared in advance to be compatible with one of the three dielectric probes. In addition to the "macroscopic" samples making up the hydrocarbonaceous formation, properties are evaluated on individual constituents such as specific hydrocarbon compositions, kerogen, water, sulfur, ammonium, or other constituents that naturally reside in the formation. These properties find application in later stochastic hydrocarbon property models.

The frequency range has been chosen to cover the typical industrial capacitive heating range (300 kHz to 100 MHz) and lower frequencies (down to 100 Hz) to determine DC or low frequency electrical conductivity. This range also identifies Debye resonance locations of various constituents that comprise hydrocarbonaceous matter, such as very complex hydrocarbon molecular chains. The temperature range of 0° C. to 99° C. for the fluid carrier medium 26, 320 has been chosen to coincide with the desire to keep the fluid carrier medium 26, 320 from vaporizing or limiting the vaporization where the hydrocarbon formation is being heated.

Impedance is measured on the samples (both shunt resistance and capacitance). Then, electric permittivity $\epsilon'$, permittivity loss factor $\epsilon''$, and electrical conductivity $\sigma$ is calculated based on the material thickness, test fixture calibration factors (Hewlett Packard. 1995. *Measuring the Dielectric Constant of Solid Materials—HP* 4194*A Impedance/Gain-Phase Analyzer*. Hewlett Packard Application Note 339-13.) and swept frequency data. The following discussion provides details on the technical background covering the dielectric properties of hydrocarbons including Debye resonances.

Modeling and Predicting Capacitive Heating Performance

A mathematical model and computer simulation program can model and predict the capacitive heating performance of hydrocarbonaceous materials based on the characterized dielectric properties.

There are underlying mathematical models that form the basis of the overall simulation. The electric permittivity has been classically modeled using Debye equations (Barber, H. 1983. *Electroheat*. London: Granada Publishing Limited; Metaxas, A. C. and Meredith, R. J. 1983. In *Industrial Microwave Heating*. Peter Peregrinus Ltd.; and Ramo, S., J. R. Whinnery, and T. Van Duzer. 1994. *Fields and Waves in Communications Electronics,* 3rd edition. New York: John Wiley & Sons, Inc.). These equations can be used to model a variety of relaxation processes associated with dielectric alignments or shifts in response to external varying electric fields. Each of these alignment processes has a corresponding relaxation time $T_0$ that is a function of several parameters of the atomic and molecular makeup of a medium 24, and therefore is a measure of the highest frequency for which these phenomena can occur. At a frequency which equals $1/2\pi T_0$, a Debye Resonance occurs which results in a peak in the loss factor $\epsilon''$. A model for the permittivity using a Debye function for a single relaxation process is shown in Equation (5):

$$\epsilon=\epsilon_0[\epsilon_\infty+(\epsilon_d-\epsilon_\infty)/(1+j\omega T_0)] \tag{5}$$

where $\epsilon_d$=Low Frequency Dielectric Constant of a Medium (f<<Debye Resonance).

$E_\infty$=High Frequency Dielectric Constant of a Medium (f>>Debye Resonance).

$\epsilon_0$=Permittivity of Free Space (8.854e-12 F/m). Therefore, from Equation (1) it can be shown that the real and imaginary components of the permittivity are given for a single Debye resonance as follows:

$$\epsilon'=\epsilon_0[\epsilon_\infty+(\epsilon_d-\epsilon_\infty)/(1+j\omega^2T_0^2)] \tag{6}$$

$$\epsilon''=\omega T_0\epsilon_0(\epsilon_d-\epsilon_\infty)/(1+\omega^2T_0^2) \tag{7}$$

$\epsilon_d$ is typically an order of magnitude or more larger than $\epsilon_\infty$, and so from inspection of equations (6) and (7), it is seen that in the vicinity of a Debye resonance, $\epsilon'$ drops off rapidly and there is a peak in the loss factor $\epsilon''$. When a composite medium 24 containing multiple relaxation times exists, then the more general purpose model can be represented as a summation of Debye terms as given by Equation (8) (loss term only) (Metaxas and Meredith, 1983):

$$\epsilon'' = \sum_{\tau=\tau_0}^{\tau_n} g(\tau)[\omega\tau/(1+\omega^2\tau^2)]\Delta\tau \tag{8}$$

where $g(\tau)$ is the fraction of orientation polarization processes in each interval $\Delta T$.

This summation assumes a linear combination of polarizations or Debye resonances. More complex mathematical models also exist for multiple Debye resonances if linearity is not assumed, and for complex composite dielectric materials with varying geometrical arrangements of the constituents (Neelakanta, P. S. 1995. *Handbook of Electromagnetic Materials. Monolithic and Composite Versions and Their Applications*. New York: CRC Press). In the case of heterogeneous bitumen or other hydrocarboneous formations, stochastic variables need to be included to model the relative concentrations and spatial distributions of the various constituents, and a Monte Carlo analysis performed to determine the statistical composite dielectric behavior in each block of a 3-D finite element partitioning model of the medium.

It can be shown (Roussy, G., J. A. Pearce. 1995. *Foundations and Industrial Applications of Microwaves and Radio Frequency Fields. Physical and Chemical Processes*. New York: John Wiley & Sons; Barber, 1983; Metaxus and Meredith, 1983) that the power per unit volume ($P_V$) delivered to a medium for a given electric field intensity is represented by the following:

$$P_V=Q_{gen}=(\omega\epsilon''+\sigma)|E|^2 \tag{9}$$

This reduces to the following when $\omega E''>>\sigma$:

$$Q_{gen}(x,y,z,t)=P_V=E^2\omega\epsilon'' \tag{10}$$

where E is again the RMS value of the electric field intensity. So for a given electric field intensity, peaks in the permittivity loss factor $\epsilon''$ results in peaks in the energy imparted to a medium, resulting in more efficient and rapid heating. Assuming for the moment that there is no heat transfer into or out of a medium due to convection or conduction, the heating time $t_h$ for a given temperature rise ($\Delta T$) due to dielectric heating is then given by Equation (11) (Orfeuil, 1987):

$$t_h=C_P\rho\Delta T/E^2\omega\epsilon'' \tag{11}$$

where $C_P$=Specific Heat of the Medium (J/Kg° C.)

$\rho$=Density of Medium (Kg/m$^3$)

and all the other parameters are as previously defined.

The more general purpose conservation of energy equation that accounts for heat transfer (convection or conduction from adjacent areas) and heat generation (dielectric heating source term) is given as follows (Roussy and Pearce, 1995):

$$\rho C_P(\partial T/\partial t)-\nabla\cdot(K_T\nabla T)=Q_{gen}(x,y,z,t) \tag{12}$$

where $K_T$=thermal conductivity of the medium and t=time; all other parameters are as previously defined.

In a similar fashion, the general purpose governing equation solving for the electric field (from Maxwell's equations in differential form) is as follows (Roussy and Pearce, 1995):

$$\nabla^2V-\mu\epsilon(\partial^2V/\partial t^2)=-\rho_V/\epsilon \tag{13}$$

where $\rho_V$=Charge Density, and V=Electric Potential or Voltage.

Equation (13) is also referred to as the Helmholtz equation, and in cases where the time derivative is zero, it reduces to Poisson's Equation.

When the medium is a passive source-less medium such as hydrocarbons and when the frequency of operation is low enough where the wavelength is long compared to sample dimensions such as in the case of capacitive heating (i.e., quasi-static model), Equation (13) reduces to the following:

$$\nabla^2V=0 \tag{14}$$

The electric field is related to the voltage by the following equation:

$$E=-\nabla V \tag{15}$$

Or simply stated, the electric field is the negative gradient of voltage in three dimensions.

Equations (8), (9), (12), (14) and (15) form the basis for an electromagnetic dielectric heating model which can be applied to a composite dielectric model, to model a hydrocarbonaceous substance having several subconstituents.

In addition, it is possible to make a composite series model for specific compositions that reside in hydrocarbonaceous materials, sample sandwiched top-and-bottom by an air or water layer, and electrodes. From earlier discussion it is apparent that the dielectric parameters are all functions of temperature and frequency. It is also true from Equations (9) and (10) that the power generated for heating is a function of the dielectric loss factor and electric field intensity. Finally, it can be deduced from Equations (13)–(15) that the electric field intensity is a function of the dielectric parameters, which in turn are functions of temperature and frequency. Therefore an iterative solving algorithm can be developed to solve for all the desired parameters in this model, one that also sequences in time, cycling back and forth between the electromagnetic and thermal solutions and solves them as a function of frequency.

Thus, characterizing the dielectric properties and predicting capacitive heating performance of hydrocarbon formations will allow heating at the optimum frequencies to decrease viscosity of hydrocarbons and chemical compositions such as waxes. And, frequencies or exposure times that are detrimental to the extraction and/or purification processes can be avoided.

The various chemical compositions that reside in hydrocarbonaceous matter may have optimum Debye resonances or frequencies where capacitive RF dielectric heating will be the most efficient. As described in the First Approach section above, the capacitive RF dielectric heating system can be set to target those optimum frequencies. These possible Debye resonances in hydrocarbons will have particular temperature dependencies. The capacitive RF dielectric heating system will be designed to track those temperature dependencies during heating as the temperature rises. The targeted chemical compositions that reside in the hydrocarbonaceous matter may have other optimum frequencies that are not necessarily Debye resonances but are still proven to be important frequencies for achieving various desired benefits in either the hydrocarbons or surrounding compositions of the hydrocarbonaceous formation. The capacitive RF dielectric heating system will be capable of targeting those frequencies and tracking any of their temperature dependencies.

Target hydrocarbons or certain compositions within the formation may also have Debye resonances or other non-Debye optimum frequencies that are proven to be especially effective in achieving selective heating of the targeted product. The capacitive RF dielectric heating system will be capable of targeting those optimum frequencies and tracking them with temperature to achieve selective control of the heat rate of the targeted composition.

Under the circumstances of one technique, which will be discussed in more detail elsewhere, the hydrocarbonaceous formation is exposed to a cavern containing a fluid carrier medium, which is made "invisible", or transparent, to the applied RF electric fields, so that the fluid carrier medium does not reach its boiling point. Accordingly, the fluid carrier medium and the corresponding capacitive RF dielectric heating system is designed for such performance and compatibility.

The capacitive RF dielectric heating system will be designed to target the Debye resonances of various chemical compositions that reside in hydrocarbonaceous formations, either simultaneously or in a time-multiplexed manner that approximates simultaneous heating behavior. The frequency and heating profile would be designed to allow for the heating of the formation or specific chemical compositions, and supplementary transfer of heat to the fluid carrier medium with minimal or controlled vaporization.

Alternatively, the specific compositions that reside in hydrocarbonaceous matter may have similar dielectric properties, such as similar Debye resonances, and/or dielectric loss factors, thus allowing for more uniform heating.

Operation: FIGS. 11A–11E: Potential Process Flow Applications

There are several potential applications of this technology for recovery of hydrocarbons from deposits such as tar sand bitumen, oil shale, coal, heavy oil, and other bituminous or viscous petroliferous deposits. These are shown in FIGS. 11A through 11E in schematic form.

Figure 11A:
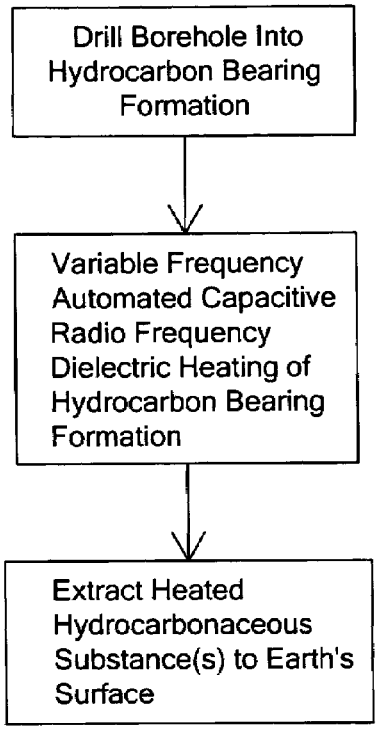
FIGS. 11A through 11E are block diagrams of five hydrocarbon heating and extraction process flows which benefit from use of a dielectric heating system.

FIG. 11A shows a flow diagram for a process of capacitive RF dielectric heating of a hydrocarbon-bearing formation, where the device can be tuned to preferentially or selectively heat specific compositions such as hydrocarbons by targeting Debye resonances. This flow could also represent the capacitive RF dielectric heating of a mixed particulate slurry (e.g., heated hydrocarbonaceous matter).

Figure 11B:
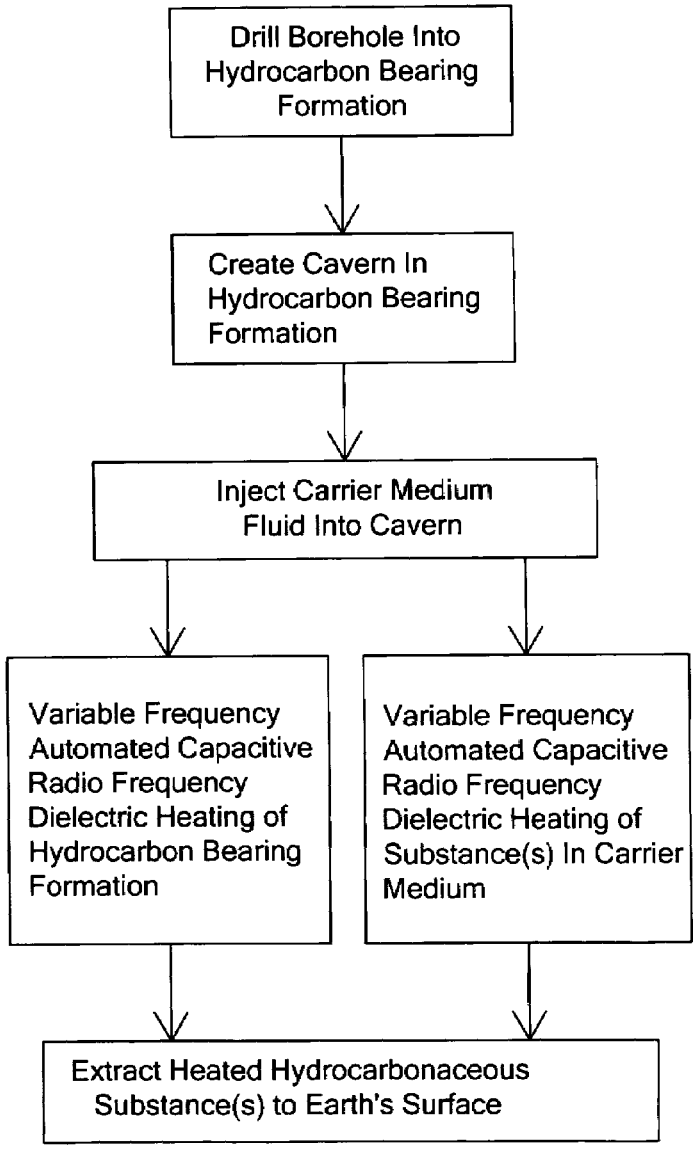

FIG. 11B is a flow diagram showing a process for capacitive RF dielectric heating of hydrocarbon-bearing formations within a subterranean environment, where specific hydrocarbon molecules within the hydrocarbon-bearing formation can be heated with greater intensity than other constituents, such as sand, sulfur, or fluid carrier medium (as will be discussed in detail elsewhere). Conversely, the device may be tuned to preferentially or selectively heat a fluid carrier medium, which can be a liquid solution, by targeting its Debye resonances instead. The creation of a cavern filled with a fluid carrier medium allows for heating of a hydrocarbon-bearing layer as it comes into contact with the fluid carrier medium.

Figure 11C:
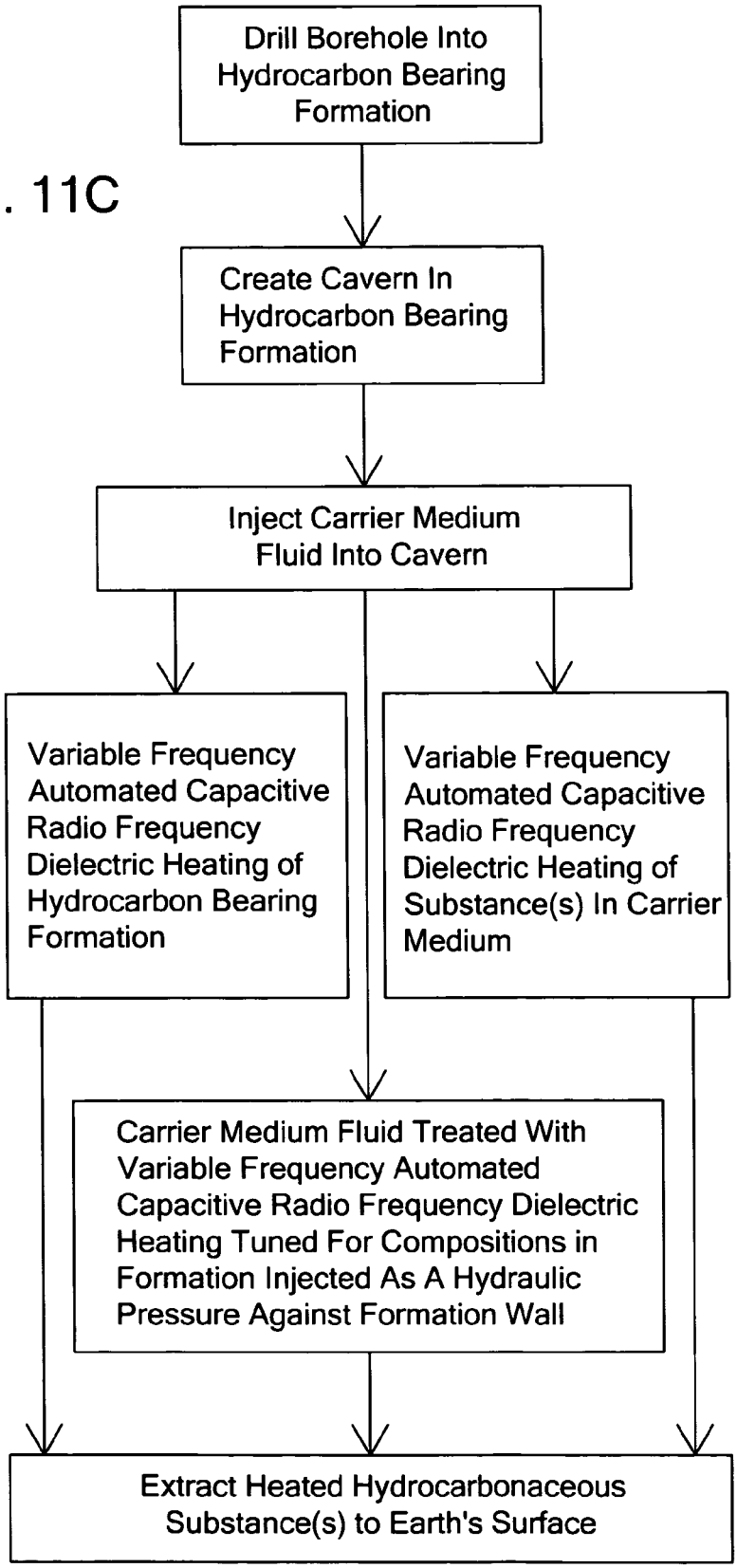

FIG. 11C is a flow diagram summarizing a process for capacitive RF dielectric heating of hydrocarbon-bearing formations within a subterranean environment, where specific chemical compositions are targeted to be heated with greater intensity than other constituents. To break off stubborn sections of the deposit into a fluid-filled reservoir within the subterranean cavern, hydraulic pressure of the fluid carrier medium is used against the hydrocarbon-bearing formation. The fluid carrier medium can be treated with variable frequency automated capacitive radio frequency dielectric heating tuned for targeted compositions.

Figure 11D:
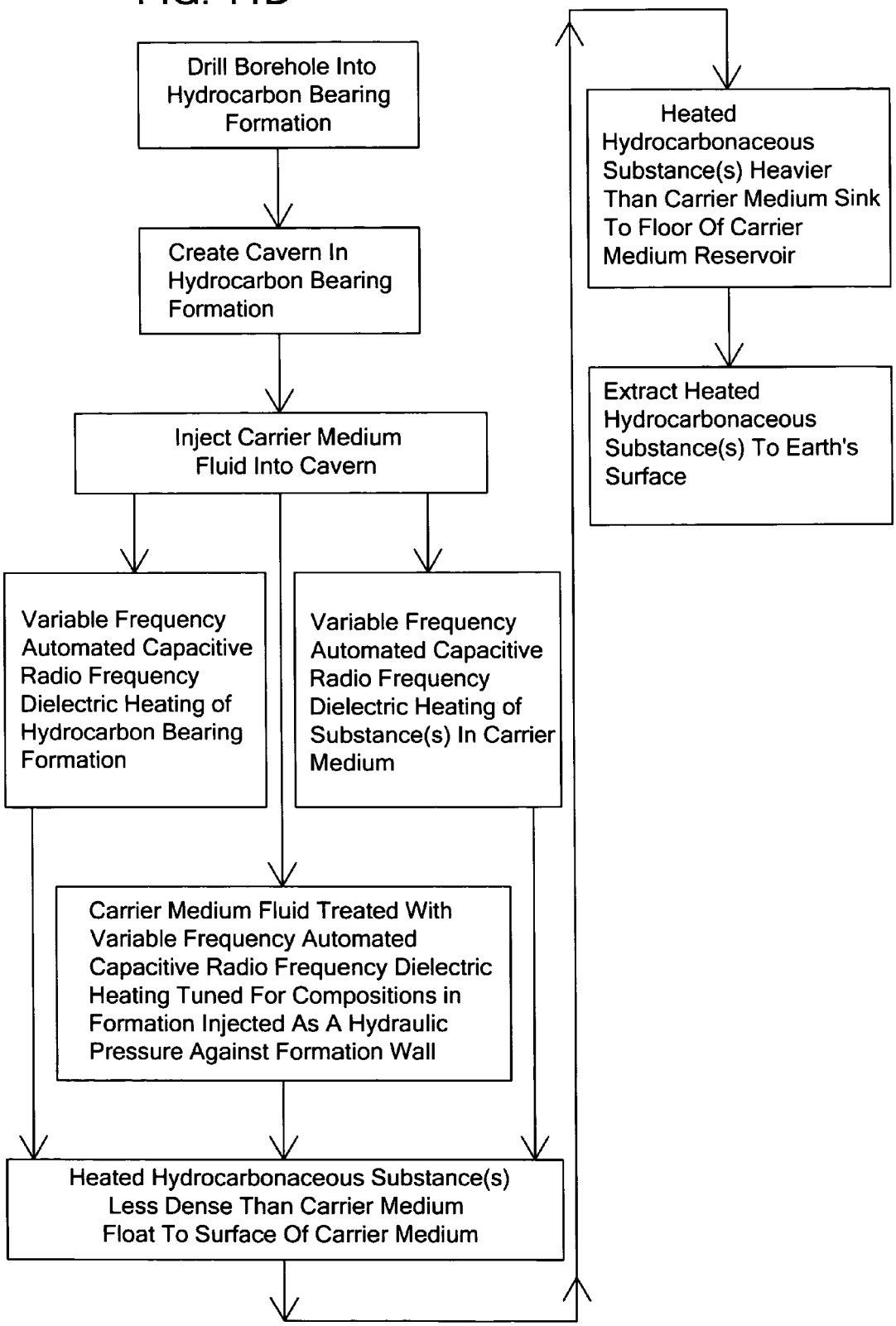

FIG. 11D shows a flow diagram for a process for capacitive RF dielectric heating of hydrocarbon-bearing formations within a subterranean environment, where specific hydrocarbon molecules or other chemical compositions within a hydrocarbonaceous medium can be heated with greater intensity than other constituents, such as sand, sulfur, or a fluid carrier medium. By creating a cavern (as will be shown elsewhere) with a fluid carrier medium, a process can be instituted to separate the desired substances that are lighter than the fluid carrier medium. These desired hydrocarbons will typically be heated as they are tuned to the RF, and they will typically rise to the surface of the subterranean carrier-medium reservoir. The undesirable foreign matter that is heavier than the desirable hydrocarbons and fluid carrier medium will settle to the bottom of the reservoir. The foreign matter will typically remain relatively cool because it is tuned to be invisible to the RF.

Figure 11E:
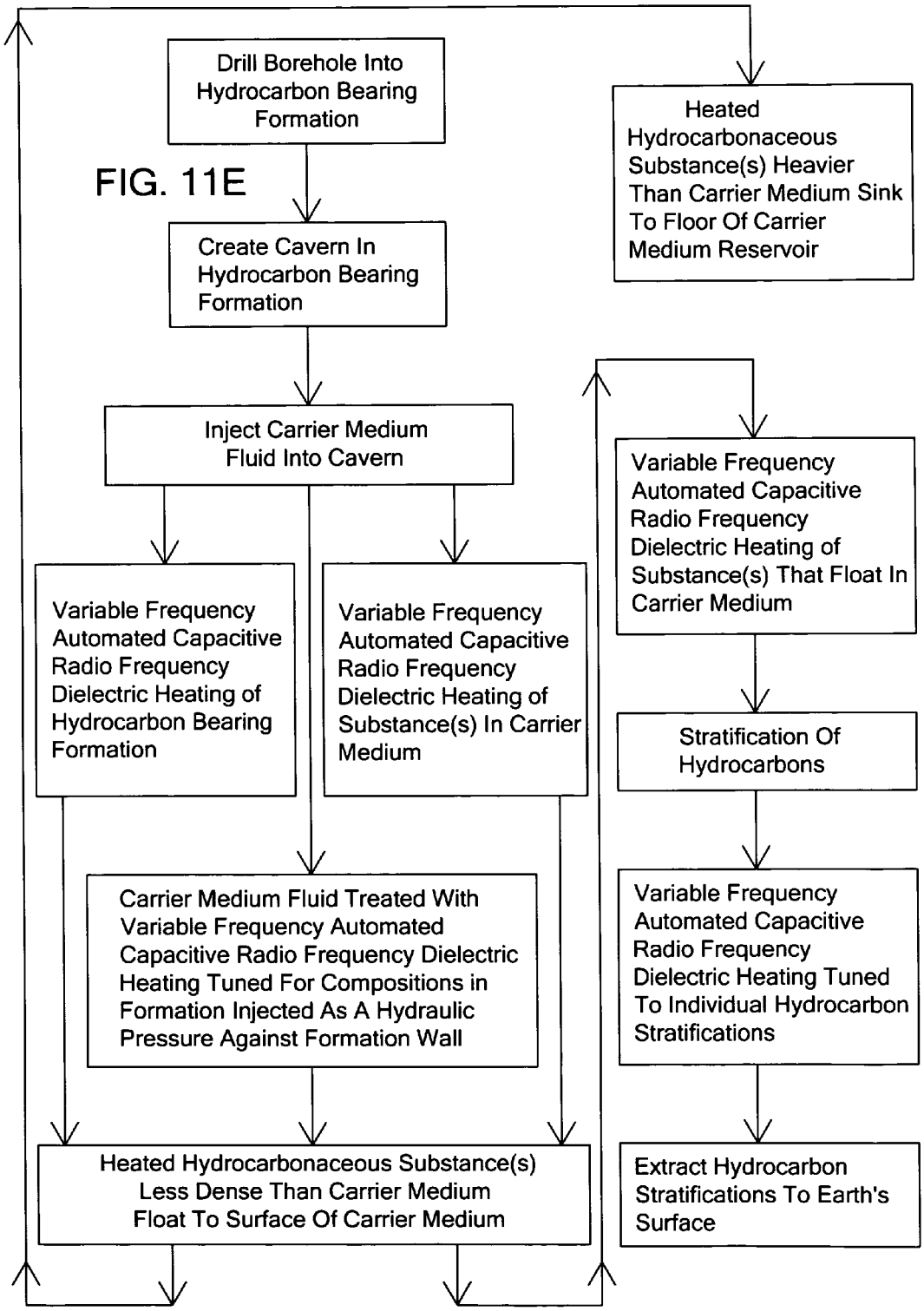

FIG. 11E is a flow chart summarizing a process involving variable frequency automated capacitive radio frequency dielectric heating of individual stratifications that rise to the surface of the fluid carrier medium. Once above the fluid carrier medium, these stratifications can be rapidly heated to several hundred degrees Celsius to create a process that further stratifies the various hydrocarbon chains by density prior to withdrawal to the surface.

Figure 12:
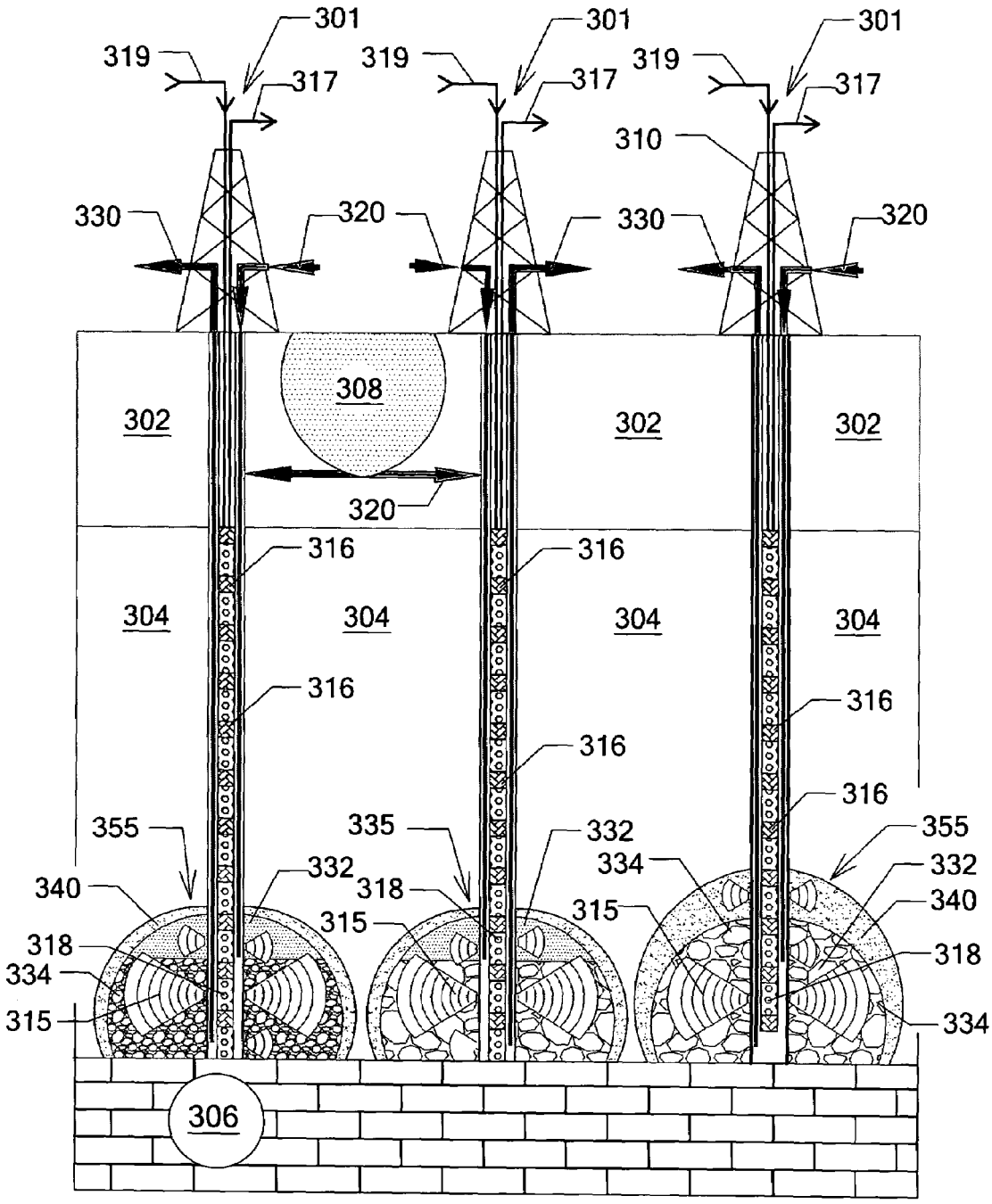
FIG. 12 shows three frequency generating and monitoring wells with their devices activated at the bottom of a hyrdrocarbonaceous deposit.

FIG. 12: Method of Hydrocarbon Extraction and Processing—Phase 1

FIG. 12 shows a hydrocarbonaceous formation (medium 304) between an overburden 302 and bedrock or soil 306. Three wells 301 are shown, in this example, and their variable frequency automated capacitive radio frequency dielectric heating systems have recently been activated. Along the length of the borehole well casing, existing and future frequency-emitting devices 318 are shown as hexagons. The frequency(s) being transmitted are represented by radio waves 315, which spread through a fluid carrier medium 320, in what will become a main cavern 335 (center) and satellite caverns 355, to a hydrocarbon-bearing formation, medium 304. Initially, hydrocarbonaceous materials 330 and/or other materials (usually a mixture of tar sands, bitumen, rock, gravel, and other hydrocarbonaceous matter) are being pumped upward to the surface (depicted by arrows pointing upward). Fluid carrier medium 320, drawn from a storage reservoir 308, is being injected downward into caverns 335 and 355 (represented by downward arrows). Caverns 335 and 355, which may begin as part of the hydrocarbonaceous formation (medium 304) and not be caverns at all, are continuously formed and enlarged as medium 304 is being heated and contents are removed. Derricks 310 are used for boring holes, and for placing well casings and piping. (contents of cavern such as melted bitumen tar sands or blasted oil shale as the cavern is being formed during the cavern's initial creation is represented by 328.)

Frequency emitting devices 318, with heater grid electrodes (such as electrodes 20 and 22, not shown) and process sensing devices (such as heat sensors 42, not shown) along with other necessary equipment, can be raised and lowered through the boreholes with derricks 310. As cavern 335 and 355 expand, reservoirs 332 of fluid carrier medium 304 with or without other material begin to form and increase in volume and/or pressure. As will be discussed later, some reservoirs 332 will become main reservoirs 338.

Medium 304 that is being heated is shown in FIG. 12 as medium being heat-treated 334 or 340, and it is preferably targeted to be near the perimeter of caverns 335 or 355. The magnitude (horizontal and/or vertical depth of medium 304, or distance from frequency emitting devices 318) of medium being treated 334 can vary, depending on the characteristics and properties of the formation and the desired hydrocarbonaceous materials. The well at the far right in FIG. 12 is in its very early stages of heat-treating medium 304 (as depicted by medium being heat-treated 334), and the middle and left-most wells are further along in the processing of the hydrocarbonaceous formation (as shown by medium being heat-treated 340). Medium being heat-treated 334 and 340 can be similar in conformation, or they may be different as a result of being at different stages of processing and extraction.

Process monitoring devices 316, such as voltage, current, temperature, and infrared thermal sensors or other devices, are shown as a herringbone pattern along the length of the well casings. These monitoring devices 316 perform a number of functions, including, but not limited to, the following:

(1) Tracking changes to the targeted chemical compositions being heated and gather all information that affects variable frequency automated capacitive radio frequency dielectric heating, so adjustments can be made that will further rapidly heat the substance(s); and (2) Monitoring all aspects of the environment within the well and subsequent caverns, such as:

(a) Water temperature, pressure, gradient differentials (b) Compositions of all particulate in water (c) Electrical Conductivity (d) Electrical Permittivity (e) Temperatures, pressures, gradient differentials of all particulates in medium 304 and fluid carrier medium 320 in reservoir 332 and surrounding cavern walls (f) Temperature and composition of cavern walls for future planning of heating operations Frequency-emitting devices 318 receive power via transmission cable 319. Data cable 317 conveys sensory information from monitoring devices 316 to computer 38 or 138.

As depicted in FIG. 12, each borehole begins providing variable frequency automated capacitive radio frequency dielectric heating to rapidly raise the temperature near the bottom of the hydrocarbonaceous formation. A typical arrangement has a flexible coaxial transmission cable 319 to power frequency emitting devices 318 (with electrodes 20 and 22, not shown). Sensors 316 are inserted into one or more vertical or horizontal boreholes in the area to be heated. Above-ground RF generators supply energy through coaxial transmission cable(s) 319 to electromagnetically-coupled down-hole electrodes 20 and 22, which are preferably part of frequency-emitting devices 318. Sub-surface material between electrodes 20 and 22 rises in temperature as it absorbs electromagnetic energy. When properly configured, the system can provide spatially-controlled heating patterns by adjusting the operating frequency, electrical phasing of currents of electrodes 20 and 22, and electrode size and location.

Fluid carrier medium 320 is preferably water, but it can be virtually any fluid, such as, but not limited to, de-ionized water, a saline water solution, or liquid carbon dioxide, for example. Fluid carrier medium 320 is pumped into one or more caverns 335 and 355, to increase reservoir level and/or pressure, and/or to serve as a coolant to prevent fluid carrier medium 320 within reservoirs 332 from reaching its boiling point. In some cases, the carrier medium can be removed from reservoirs 332 to relieve pressure.

Initially, this process can require more fluid carrier medium 320, depending largely on the water content of the formation and the amount of water that the formation can contribute to the process, than current methods that require steam and high energy inputs for both subterranean extraction and subsequent above-ground washing. However, overall, the amount of fluid carrier medium 320 and energy required is significantly less than current methods.

Whenever practical, deep lake reservoirs should be built to generate hydroelectric power for the frequency generating and monitoring devices, and to maintain a reserve of fluid carrier medium 320. If properly designed, fluid carrier medium 320 can be recovered from the bottom of cavern 335 and 355 to reduce or eliminate the energy requirements of pumping into the cavern. This process can continue after mining is completed, as a cost effective method of maintaining pressure, when desired, on fluid carrier medium 320 in the cavern and subsequent natural gas reserve pressures.

Figure 13:
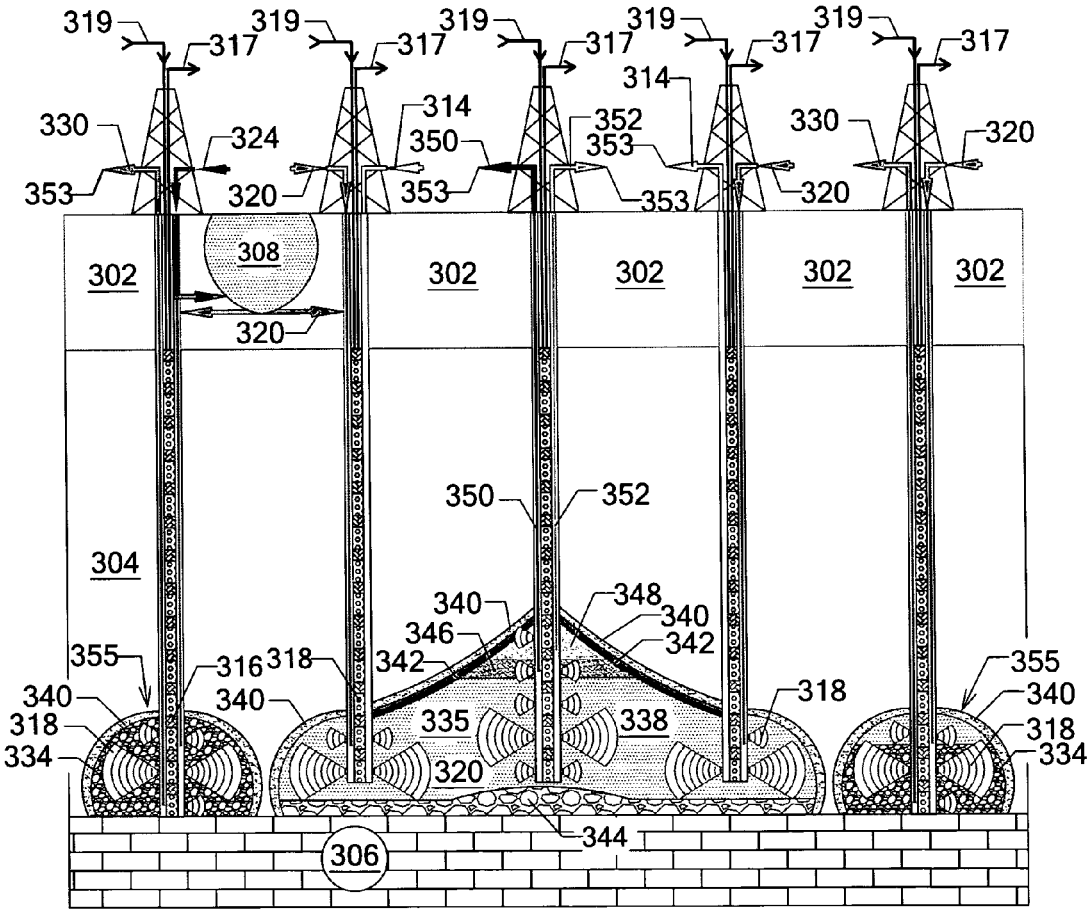
FIG. 13 shows a cavern opening upward in the center to form a larger, cone-shaped main cavern 335.

FIG. 13: Method of Hydrocarbon Extraction and Processing—Phase 2

FIG. 13 shows an example of a main cavern 335 which has been formed by the three developing caverns 335 and 355 from FIG. 12 converging together as they are expanded during the process. Cavern 335 (one cavern formed from the three in FIG. 12) has become cone-shaped, and its roof peaks upward in its center. Reservoirs 332 from FIG. 12 have also conjoined to form main reservoir 338. The cone-shaped cavern is desirable for several reasons, such as the following:

(1) A cone-shaped cavern encourages heated hydrocarbonaceous matter to propagate towards the center of cavern 335. As the hydrocarbonaceous formation viscosity decreases near main reservoir 338, it will propagate from medium 304 to fluid carrier medium 320 in reservoir 338. For example, as heated tar sand makes contact with fluid carrier medium 320, the bitumen will float on fluid carrier medium 320 while the sand and other debris will sink to the bottom of reservoir 338 as sediment 344. The heated bitumen and hydrocarbons can be brought to the surface after rising to the surface of fluid carrier medium 320;

(2) A cone-shaped cavern provides maximum surface area of fluid carrier medium 320 that is exposed to medium 304.

(3) A cone-shaped cavern allows for effective placement of separated foreign matter as the cavern opens outwardly at the base bottom of the deposit and up from the center, thus creating an environment that settles the sediment towards the center of the cavern floor.

Many valuable hydrocarbon compounds with low boiling points are lost with conventional techniques that use high temperatures (above boiling) and rapid heating techniques. Paraffin has a cloud point of 40° C., and a re-melting point of 60° C. The constant heating of medium 304 with a means that can control temperature of all targeted compositions, and with a means for the oils with lowered viscosity to collect via the fluid carrier medium 320, allows for a process technique that is cooler relative to conventional methods. A smaller temperature rise of the hydrocarbons will mean that more hydrocarbons of the formation can be extracted, and fewer will be lost to flashing-off. A lowered viscosity of heated hydrocarbonaceous fluid is a result of reducing the amount of hydrocarbons that flash off. One of the problems of high temperatures and/or rapid heating in conventional processes is that as more hydrocarbons flash from off from the heated hydrocarbonaceous fluid, the viscosity of the fluid increases. The process disclosed here eliminates or significantly reduces this problem.

As the heated bitumen and melted waxes rise to the surface of fluid carrier medium 320 in cavern 335 in FIG. 13, the more narrow the horizontal cross section of the cavern is, the thicker the bands of melted bitumen, hydrocarbons, waxes, and natural gas stratifications will be. The deeper stratifications allow for tailored heating frequency(s) of these stratifications. With thicker stratifications, even more fractions can be created (from the initial fractions) and individually extracted. A deep stratification will be more conducive and efficient for frequency heating than a thin layer of a certain composition, since each stratification may require tailored variable frequency automated capacitive radio frequency dielectric heating. The heating of the individual stratifications can reach temperatures as high as 900 degrees Celsius.

As FIG. 13 shows, main cavern 335 has now been sufficiently opened and shaped so it can be filled with fluid carrier medium 320 that conducts the frequencies to medium 304. Reservoir 338 with fluid carrier medium 320 and/or other liquids (such as water that is freed from the formation) functions to settle out foreign matter as sediment 344 onto the cavern floor. It should be noted that fluids such as saline waters can be conductive for hundreds of feet.

A layer 340 of medium being treated 334 is typically between the bulk of the hydrocarbon-bearing formation and the cavern fluid carrier medium 320. Typically, the cavern walls and roof are being heated. The melted bitumen or released oils and hydrocarbons are expected to rise to the surface of reservoir 338 either as a layer 342 against the cavern roof or as bubbles near the surface of reservoir 338 (not labeled). The foreign matter (compositions that do not contain sufficient hydrocarbons or that have densities greater than fluid carrier medium 320) is settled as sediment 344 onto the floor of the cavern.

As the heating process continues, a stratified layer 356 of hydrocarbonaceous particulates begins to form. The melted bitumen, oils, and hydrocarbons that float to the surface of fluid carrier medium 320 are shown as stratified layer 346 in FIG. 13. Stratified layer 346 is extracted with piping 350. Natural gases form stratified layer 348, and they collect at the top of cavern 335. Stratified layer 348 is extracted with piping 352.

The wells at the far right and far left in FIG. 13 are in the early phase of processing. Caverns such as these satellite caverns 355 are formed around main cavern 335. The hydrocarbon-bearing formation (medium 304) is being heat-treated 334 in caverns 355 in preparation of main cavern 335 expanding into these regions. Fresh fluid carrier medium 320 is pumped into caverns 355, if necessary, and heated bitumen (medium being heat-treated 334) is waiting to be pumped out to enlarge or form caverns 355. These caverns 355 will have many purposes. One to act as a process retort chamber used to heat the constituents. Another use for the chamber is as a production well to collect heated hydrocarbons for removal to earth's surface.

Figure 14:
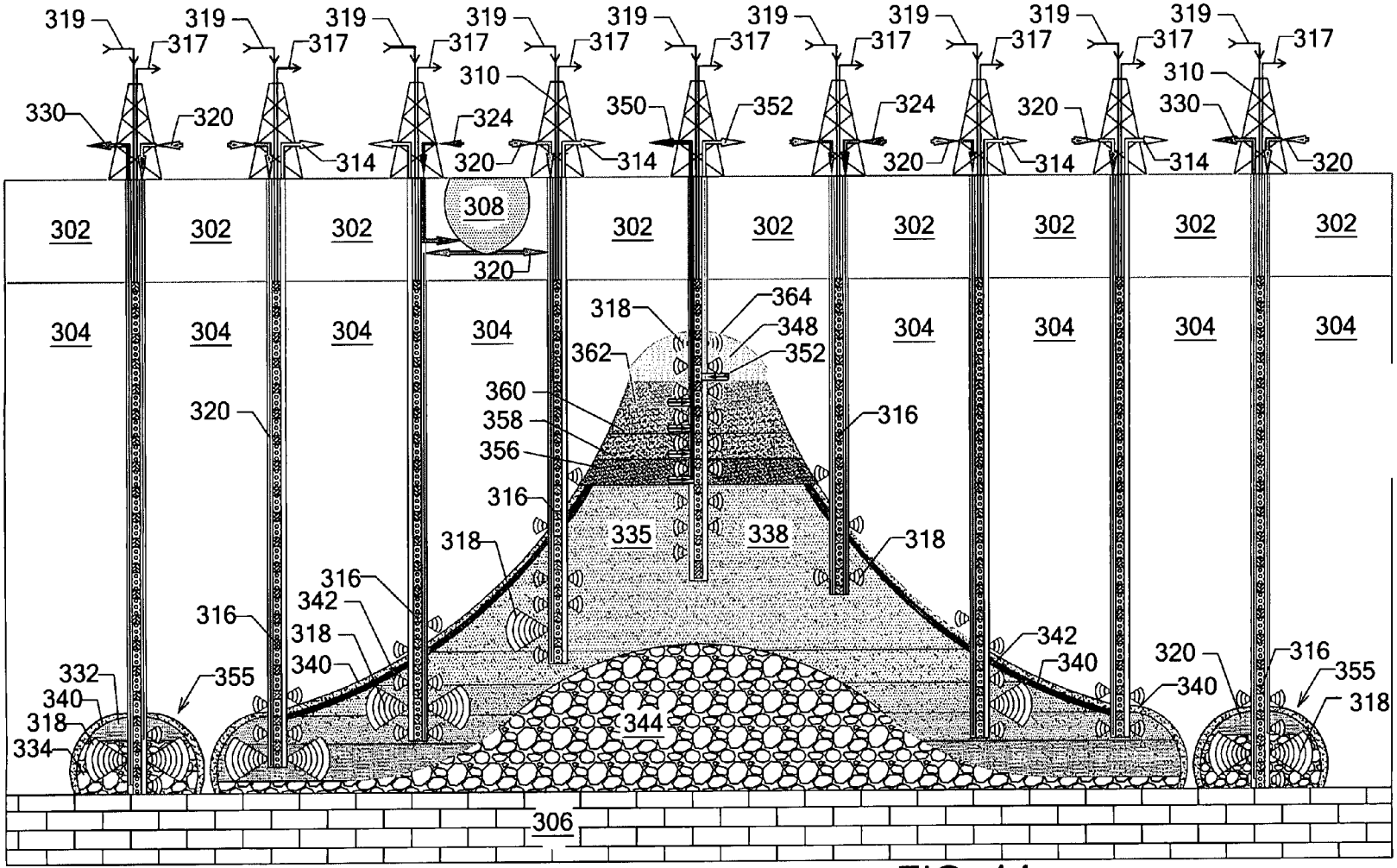
FIG. 14 shows a main cavern expanded to include the adjacent caverns seen in FIG. 13.

FIG. 14: Method of Hydrocarbon Extraction and Processing—Phase 3

In FIG. 14, main cavern 335 has expanded to include caverns 355 from FIG. 13. The process of opening up and activating more wells (at far right and left in FIG. 14) to expand cavern 335 continues. The center of cavern 335 has risen and widened, and now has a dome cap 364. There is now ample room for the level of reservoir 338 to reach the upwardly inclining walls and roof of cavern 335. Pressure differentials are forming within cavern 335 due to the increasing depths of reservoir 338. The bed of sediment 344 is increasing in depth.

By Phase 3, in FIG. 14, the melted bitumen, oils, and hydrocarbons have stratified to their different layers, with a stratified layer 356 comprising more dense compounds, a stratified layer 362 comprising less dense compounds, and stratified layers 358 and 360 comprising compounds with densities somewhere between those of stratified layer 356 and stratified layer 362. Methane and other gases rise to form stratified layer 348.

Figure 15:
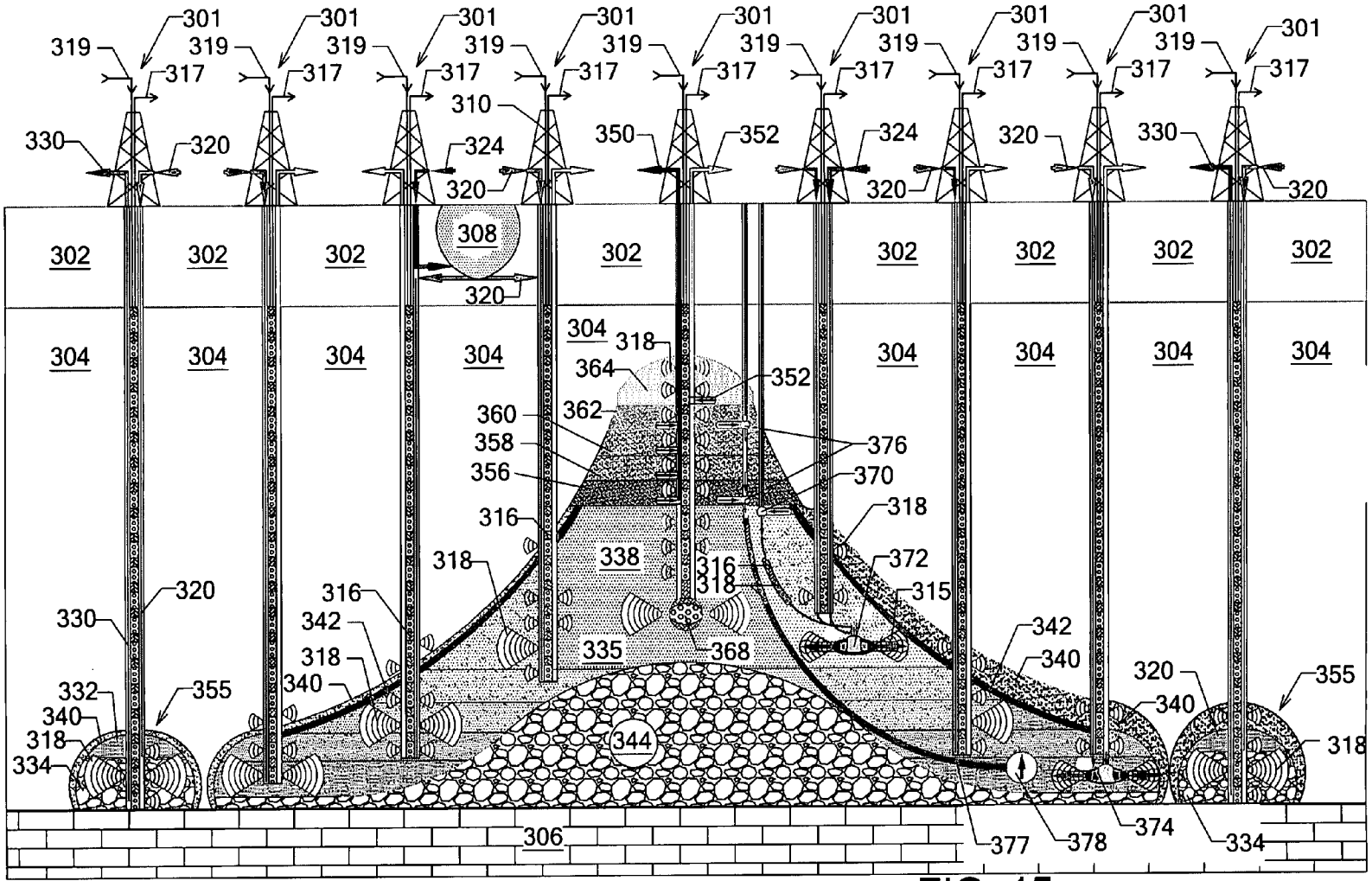
FIG. 15 shows the main cavern, which will soon be limited in its outward and upward spread into the formation, and will begin to appear dome-shaped as the formation is exploited.
Figure 16:
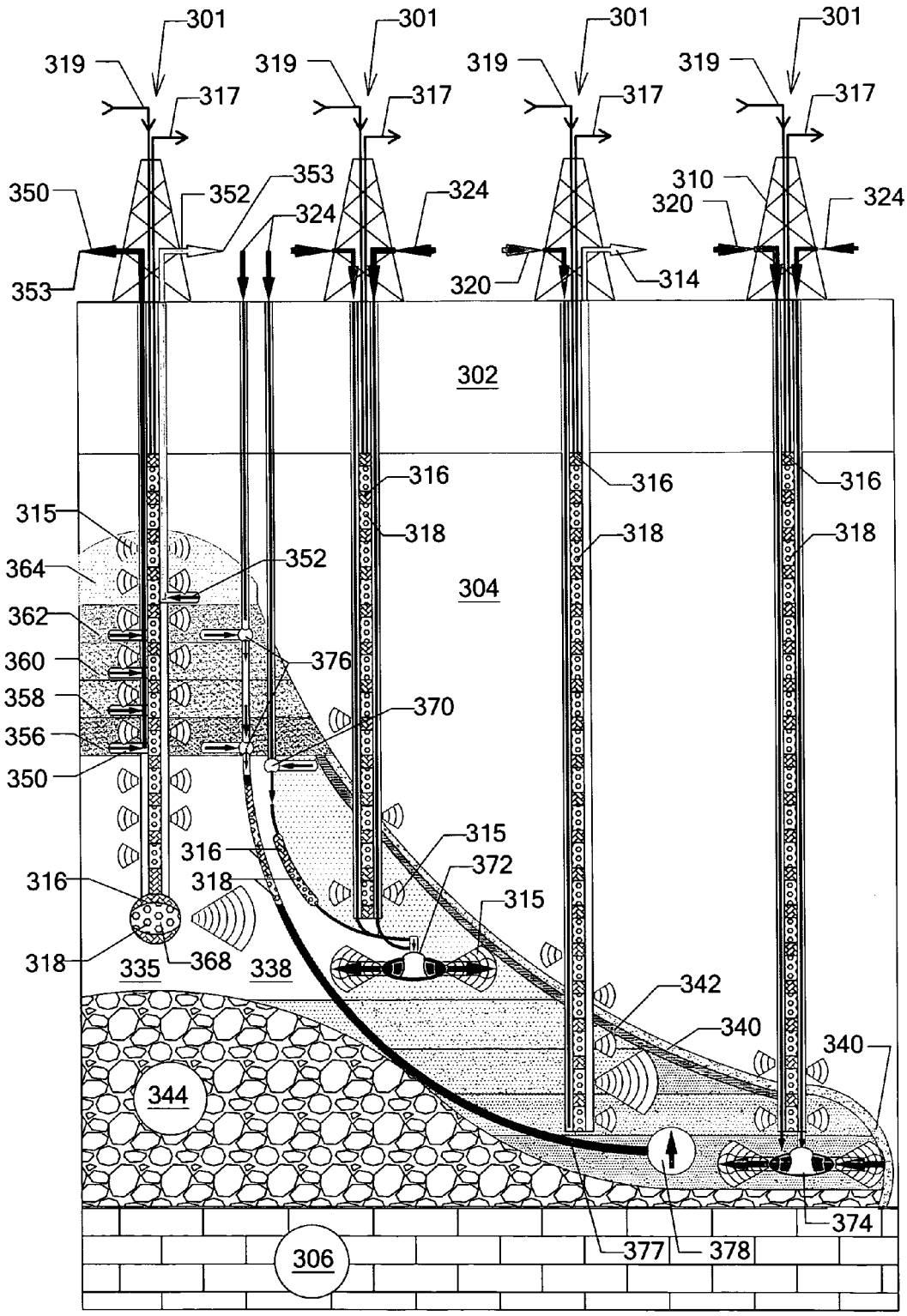
FIG. 16 shows a close up of the main cavern, within brackets 16—16 from FIG. 15, and several process techniques.

FIG. 15 and 16: Method of Hydrocarbon Extraction and Processing—Phase 4

FIGS. 15 and 16 depict an advanced phase of many of the techniques presented in this invention. Cavern 335 in FIG. 15 and in the close-up view of FIG. 16 will soon be limited on outward spread into the formation and has expanded upwards near the top of the hydrocarbon-bearing formation, medium 304. By now, the cone shape of the cavern from FIG. 13 has become a dome shape, for full exploitation of the deposit.

A device 368 at the base of the well casing (which has been incrementally raised above the encroaching mound of sediment 344) is a high-powered frequency-generating device and an automatic impedance match-monitoring device. If the characteristics of fluid carrier medium 320 and/or reservoir 338 allow for migration of frequencies through long distances, then a centrally-located high-energy generating and monitoring device, such as device 368, is preferred, rather than a grid of wells and devices as previously described in FIGS. 12 and 13.

A process 370 recovers and recycles a layer of fluid carrier medium 320, which is generally a warmed layer of fluid carrier medium 320 immediately below stratified layer 356. If necessary, variable frequency automated capacitive radio frequency dielectric heating can be placed around or in the pipe of process 370 to rapidly heat medium 304 and fluid carrier medium 320 as a slurry process and/or to saturate reservoir 338 with RF heating frequencies to aid in the mining process.

Optional remote controlled underwater vessels 372 and 374 are tethered above ground and piped down into cavern 335. Possible uses for these devices include the following:

(a) As a method of delivering high-powered variable frequency automated capacitive radio frequency dielectric heating to specific area(s) of the hydrocarbon bearing deposit;

(b) To supply high-pressure fluid carrier medium 320 from the surface to hydraulically blast immediately adjacent hydrocarbonaceous formation into smaller parts. If fluid carrier medium 320 is used to hydraulically cut into the area being heated and/or mined, then proper frequencies should be saturated in fluid carrier medium 320 prior to discharge. Remote underwater vessel 372 has water pressure coming out both of its ends, depicted by its associated horizontal arrows, having a steady stream of fluid carrier medium 320 saturated with bitumen-heating frequencies;

(c) To enlarge cavern 335 (using remote vessel 374) by jettisoning particulates away from the area being mined. Although not shown, a pipe can be attached to vessel 374 to convey these materials even further away from the mining area. As fluid carrier medium 320 in the area being heated becomes saturated with foreign matter settling to cavern floors, its efficiency to transmit and/or monitor the Automatic Impedance Matching Frequencies can decrease. Capturing and conveying fluid carrier medium 320 and medium 304 to another part of the cavern for further frequency heating and/or separation of foreign matter can increase efficiency.

Process 376 can recover a stratified layer or layers 356, 358, 360, and/or 362 of melted bitumen, oil, or hydrocarbons and transfer one or more of these stratified layers deep into reservoir 338. While the contents are being transported downward in the pipe, variable frequency automated capacitive radio frequency dielectric heating rapidly heats the contents of the pipe as a slurry 377. Process 376 has the potential to produce crude fractionations of hydrocarbons from heated hydrocarbon substances by rapidly heating the hydrocarbons in a slurry fashion to the necessary temperature and then releasing them under the tremendous hydrostatic pressure created by deep fluids (over 30 meters). As the contents from process 376 are released deep into cavern 335 at a location 378 (which is typically at the end of the piping for process 376), specific compounds within the contents of process 376 are bombarded with variable frequency automated capacitive radio frequency dielectric heating as they rise to the surface of cavern 335 for continued rapid heating under pressure. One skilled in the art can calculate the prescribed temperature required of the contents from process 376 in relation to the hydrostatic pressure of reservoir 338 to provide various levels of fractionating the hydrocarbons.

When required (such as for refining of more complex hydrocarbons), additives can be injected by pressure into an in-line mixer built into the piping for process 376. More than one fraction can also be blended together, with additives, and frequency heated as previously described, then released under pressure to create more complex hydrocarbon chains.

To design a satisfactory capacitive RF dielectric heating system according to the present invention, it is best to consider factors such as electric field levels, frequency schedules, geometries, and surrounding geological formations. In particular, it is helpful to have a full understanding of dielectric properties of hydrocarbonaceous materials to be heated, over a range of frequencies, temperatures, and pressures. And, it is important to avoid any factors that may cause high local intensities of field strength.

It is possible to select fluid carrier medium 320 for cavern(s) 335 and/or 355 that is essentially transparent to the RF energy over all or a portion of the 1 MHz–300 MHz normal operating range, so that heating of the hydrocarbons or other targeted chemical compositions can be accomplished without boiling fluid carrier medium 320.

The product to be heated can be surrounded with or exposed to a non-conductive dielectric coupling fluid carrier medium 320 (e.g., de-ionized water) that itself will not be heated (Debye resonance at much higher frequency) but will increase the dielectric constant of the gaps between the electrodes and the medium to be heated thus lowering the gap impedance and improving energy transfer to the medium.

It may also be helpful to supply greater heat to outer edges of medium 304 (e.g. by convection from pre-heated fluid carrier medium 320) to help compensate for the greater heat losses that occur in those areas. Or it may be of assistance to circulate relatively cool carrier medium 320 to the outer edges of medium 304 to prevent the carrier medium from boiling. This may be especially necessary when the medium 304 or specific compositions within the medium require being heated to temperatures above the boiling point of the carrier medium 320. Pre-heated fluid carrier medium 320 may be at a temperature of 0–99° C., in the case of water, or, in general, at a temperature range that is below the boiling point of the medium.

General Aspects

The capacitive RF dielectric heating system will have power control and voltage/electric field level control capabilities as well as potentially contain a gridded electrode arrangement (see FIGS. 9 and 10) to provide precise control of the field strength vs. time and position in medium 304 or fluid carrier medium 320.

In addition to the above examples of various manufacturing process flows, there also exists the potential of using this technology in combination with other heating technologies such as Ohmic or microwave heating to improve product quality, process productivity, and/or energy efficiency. Examples of this include the following: 1. Using Ohmic frequency heating in fluid carrier medium 320 to heat formations that break off into reservoir 332 and/or 338; 2. Heating compositions with microwave or Ohmic frequencies in fluid carrier medium 320 whose compositions require radio frequencies similar to constituents that are not targeted to be heated; 3. Using microwaves to create additional heat in the formation area targeted for heating; and 4. Using microwaves to create additional heat at layer 342 between fluid carrier medium 320 in reservoir 332 and/or 338 and the hydrocarbon bearing medium 304.

With the methods and apparatuses described herein, it is possible to avoid the potential disadvantages of current capacitive RF dielectric heating methods. According to the first approach, the potential limitations are addressed by providing frequency control to match Debye resonances or other parameters of the dominant constituents of medium 304, track them with temperature, control field strengths and optimize product geometries to prevent arcing. According to the second approach, automatic impedance matching ensures that the effective adjusted load impedance is matched to the output impedance of the signal generating unit, thereby ensuring that the load is heated with maximum energy (thus yielding a shorter heating time).

To prevent or reduce the risk of thermal runaway, a gridded electrode system can be used with an infrared scanner to monitor the entire body of a hydrocarbon-bearing formation (medium 304) and/or fluid carrier medium 320 being heated. In response to signals from the sensory input device(s) 316, specific compositions that reside in the hydrocarbonaceous substance such as hydrocarbons and/or other constituents can be independently heated by adjusting local field strengths or by switching some portions of the grid off in different duty cycles to prevent hot spots.

This process provides many advantages over current methods. For example, variable frequency automated capacitive radio frequency dielectric heating allows for individual processing of each individual stratification, with real time monitoring and frequency adjustments. In addition, this design requires minimal overall water usage or sediment removal compared to conventional methods. Another advantage is that maximum cavern pressure can be maintained with minimal input of water or other liquids or gases to create and maintain the necessary pressures. Additionally, the described process(s) will require significantly less energy. The alleviation of vaporizing the water in a hydrocarbon-bearing formation in itself will greatly decrease the energy requirements. Equally important, and perhaps even more so, significant amounts of green house gases and other by-products are left in its original deposit.

While this invention has been described in terms of several preferred embodiments, there are alterations, permutations, and equivalents, which fall within the scope of this invention. It should also be noted that there are many alternative ways of implementing the apparatuses and process techniques of the present invention. It is therefore intended that the following appended claims be interpreted as including all such alterations, permutations, and equivalents as fall within the true spirit and scope of the present invention. The present invention can be implemented in numerous ways, including as a process, an apparatus, a system, a device, a method, or a computer-readable medium. The present invention includes all such modifications as may come within the scope and spirit of the following claims and equivalents thereof.

I claim:

1. A method for heating a medium, said medium comprising hydrocarbonaceous material selected from the group consisting of oil shale, tar sand, oil sand, coal, bitumen, and/or kerogen, comprising: (a) subjecting said medium to an alternating current electrical field generated by a radio frequency waveform applied at a predetermined frequency range that heats said medium; (b) measuring an effective load impedance initially dependent upon the impedance of said medium; (c) comparing said effective load impedance with an output impedance of a signal generating unit that generates said radio frequency waveform; and (d) automatically adjusting said effective load impedance to match said output impedance of said signal generating unit.

2. The method of claim 1 wherein said output impedance of said signal generating unit is a predetermined constant.

3. The method of claim 2 wherein said output impedance of said signal generating unit is about 50 ohms.

4. The method of claim 1 wherein measuring said effective load impedance includes measuring a voltage across said medium and measuring a resulting electric field developed in said medium.

5. The method of claim 1 wherein measuring said effective load impedance includes measuring a current of said radio frequency waveform applied to the medium.

6. The method of claim 1 wherein measuring said effective load impedance includes measuring a voltage and a current of said radio frequency waveform applied to said medium, and determining a phase angle based on the measured voltage and measured current.

7. The method of claim 1 wherein measuring said effective load impedance includes measuring a forward power level of said radio frequency waveform applied to generate a voltage across and current through said medium and a reverse power level of said radio frequency waveform reflected from an effective load.

8. The method of claim 7, further comprising calculating a voltage standing wave ratio from said forward power level and said reverse power level.

9. The method of claim 8, further comprising repeating the act of automatically adjusting said effective load impedance until said voltage standing wave ratio is about 2:1 or less.

10. The method of claim 8, further comprising repeating the act of automatically adjusting said effective load impedance until said voltage standing wave ratio is about 1:1.

11. The method of claim 1 wherein automatically adjusting said load impedance to said output impedance of said signal generating unit includes adjusting said selected frequency of said applied radio frequency waveform.

12. The method of claim 1 wherein automatically adjusting said effective load impedance to match said output impedance of said signal generating unit includes tuning a tunable impedance matching network connected to an effective load.

13. The method of claim 1, further comprising periodically measuring at least one temperature of said medium during heating, and using said measured temperature in automatically adjusting said effective load impedance to match said output impedance of said signal generating unit.

14. The method of claim 1 wherein of said radio frequency waveform allows for a wavelength to be at least ten times greater than a longest geometrical dimension of the medium under test.

15. The method of claim 1 wherein said selected frequency of said radio frequency waveform is in a range of 1 mhz to 300 mhz.

16. The method of claim 1 wherein said radio frequency waveform is greater than about 30 mhz.

17. A method for heating specific chemical compositions that reside in hydrocarbonaceous material selected from the group consisting of oil shale, tar sand, oil sand, coal, bitumen, and/or kerogen, comprising: maintaining said hydrocarbonaceous material in an alternating current electrical field provided by a radio frequency signal at a frequency not greater than 300 mhz; and controllably heating said hydrocarbonaceous material by automatically maintaining an impedance match between an impedance of said hydrocarbonaceous material and a predetermined constant, said predetermined constant comprising an optional fluid carrier medium, which can be unaffected, when desired, by the frequencies being presented to the target elements within the formation.

18. The method of claim 17 wherein said medium is selected from the group consisting of water, saline solution and/or carbon dioxide.

19. A method for heating a medium, said medium comprising hydrocarbonaceous material contained in a subterranean environment, comprising: (a) subjecting said medium to an alternating current electrical field generated by a radio frequency waveform applied at a predetermined frequency range that heats said medium; (b) measuring an effective load impedance initially dependent upon the impedance of said medium; (c) comparing said effective load impedance with an output impedance of a signal generating unit that generates said radio frequency waveform; and (d) automatically adjusting said effective load impedance to match the output impedance of said signal generating unit.

20. A method for heating a medium, said medium comprising hydrocarbonaceous material, comprising: (a) exposing said medium to a subterranean reservoir of a carrier medium, said carrier medium being a fluid which allows radio frequency waves to travel to said medium; (b) subjecting said medium to an alternating current electrical field generated by a radio frequency waveform applied at a predetermined frequency range that heats said medium; (e) measuring an effective load impedance initially dependent upon the impedance of said medium; (d) comparing said effective load impedance with the output impedance of a signal generating unit that generates said radio frequency waveform; and (e) automatically adjusting said effective load impedance to match the output impedance of said signal generating unit.

21. The method of claim 20 wherein said medium is heated while exposed to said reservoir of said carrier medium.

22. The method of claim 20 wherein said medium that is generally adjacent to said reservoir is heated, said carrier medium in said reservoir being maintained at a temperature range below boiling point of said carrier medium.

23. The method of claim 10 wherein a desired compound within said medium forms a recoverable layer within said reservoir, and said recoverable layer can be extracted from said reservoir.

* * * * *